US008737659B2

(12) United States Patent
Suzuki et al.

(10) Patent No.: US 8,737,659 B2
(45) Date of Patent: May 27, 2014

(54) SPEAKER APPARATUS AND AUDIO OUTPUT METHOD

(75) Inventors: Nobukazu Suzuki, Kanagawa (JP); Yoshio Ohashi, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 13/638,964

(22) PCT Filed: Mar. 30, 2011

(86) PCT No.: PCT/JP2011/058662

§ 371 (c)(1), (2), (4) Date: Oct. 2, 2012

(87) PCT Pub. No.: WO2011/126034

PCT Pub. Date: Oct. 13, 2011

(65) Prior Publication Data

US 2013/0028458 A1 Jan. 31, 2013

(30) Foreign Application Priority Data

Apr. 9, 2010 (JP) ..... 2010-090503

(51) Int. Cl.
*H04R 25/00* (2006.01)

(52) U.S. Cl.
USPC ..... 381/338; 381/337; 381/182; 381/423

(58) Field of Classification Search
USPC ..... 381/332, 334, 335, 96, 338, 345, 346, 381/348, 349, 352, 396, 423, 337, 182, 381/186; 181/148, 153, 155, 156, 199
See application file for complete search history.

(56) References Cited

U.S. PATENT DOCUMENTS

| | | | | |
|---|---|---|---|---|
| 4,618,025 | A * | 10/1986 | Sherman | 181/148 |
| 5,721,786 | A * | 2/1998 | Carrington | 381/423 |
| 8,135,156 | B2 * | 3/2012 | Hu | 381/352 |
| 2007/0223734 | A1 * | 9/2007 | Suzuki et al. | 381/96 |

* cited by examiner

*Primary Examiner* — Huyen D Le
(74) *Attorney, Agent, or Firm* — Wolf, Greenfield & Sacks, P.C.

(57) ABSTRACT

The present invention allows for the further enhancement of a low pitch range with a simple structure without increasing the size.

The present invention is provided with: a pipe (102) open one end side and the other end side; a speaker unit (104) that is coaxial with the pipe (102), arranged at the one end side of the pipe (102), and driven on the basis of an audio signal; and an edge-cum-diaphragm (102B) that is coaxial with the pipe (102), installed at the other end side of the pipe (102), and vibrates in response to a sound wave that passes through the pipe (102). While the pipe (102) functions as a resonance tube by being excited to vibration with the sound wave that is radiated from the speaker unit (104) and passes through the pipe (102), the edge-cum-diaphragm (102B) functions as a passive radiator by vibrating in response to the sound wave that passes through the pipe (102).

7 Claims, 22 Drawing Sheets

(A)

(B)

CORRELATION COEFFICIENT: r12, r13, r14, r23, r24r, r34

(A)

(B)

SPEAKER APPARATUS AND AUDIO OUTPUT METHOD

TECHNICAL FIELD

The present invention relates to a speaker apparatus and an audio output method, and is preferable for application in obtaining an audio image with a sense of spread by exciting a pipe wall of a cylindrical member with a sound wave from a sounding body that is driven on the basis of an audio signal and radiating the sound wave outward from the entire outer surface of the cylindrical member.

BACKGROUND ART

Conventionally, there has been proposed a speaker system that reproduces sound by adding vibration to an acoustic diaphragm by a magnetostrictive actuator (refer to Patent Document 1, for example).

In a speaker system 1, as shown in FIG. 1, a cylindrical acoustic diaphragm 10 formed of an acrylic resin or the like is vertically supported on a discoid base housing 20, and four magnetostrictive actuators 30 are arranged at equiangular intervals in the base housing 20.

In the speaker system 1, a drive rod 35 for each magnetostrictive actuator 30 abuts on a lower end surface 12 of the acoustic diaphragm 10 to drive the magnetostrictive actuator 30 by an audio signal, so that the magnetostrictive actuator 30 adds vibration to the lower end surface 12 of the acoustic diaphragm 10 in a direction perpendicular to the lower end surface 12 of the acoustic diaphragm 10.

The lower end surface 12 of the acoustic diaphragm 10 is excited by a longitudinal wave, which mixes with a transverse wave to be a mixed wave by the propagation of a vibration elastic wave in a planar direction (a direction parallel to the surface) of the acoustic diaphragm 10, whereby a sound wave is radiated in the planar direction of the acoustic diaphragm 10 to form a uniform audio image across the entire height direction of the acoustic diaphragm 10.

Although omitted in this speaker system 1, it is also described in Patent Document 1 that a regular speaker unit is installed in a central opening part of the base housing 20.

In this case, the acoustic diaphragm 10 functions as a tweeter in charge of an upper range of an audible frequency range, and the regular speaker unit functions as a woofer in charge of a lower range of the audible frequency range.

On the other hand, there has been proposed an acoustic device including an active diaphragm provided in a spherical resonator and a passive diaphragm provided in a position facing the active diaphragm of the resonator (refer to Patent Document 2, for example).

CITATION LIST

Patent Documents

Patent Document 1: Japanese Patent Application Laid-Open No. 2007-228557

Patent Document 2: Japanese Patent Application Laid-Open No. 01-253396

SUMMARY OF THE INVENTION

Now, the speaker system 1 described in Patent Document 1 has had a problem of insufficient output of sound in a low pitch range due to a structure that the regular speaker unit alone is in charge of the lower range.

The speaker system 1 has also had problems that, since the upper part of the acoustic diaphragm 10 is open, a filter is required for eliminating resonance of a high degree, and dust enters the speaker system.

In consideration of the above respects, the present invention proposes a speaker apparatus and an audio output method, the speaker apparatus having a simple structure, excellent designability and satisfactory acoustic characteristics and capable of further enhancing the low pitch range without increasing the size.

In order to solve such problems, the present invention is provided with: a cylindrical member open on one end side and the other end side; a sounding body that is coaxial with the cylindrical member, arranged at the one end side of the cylindrical member, and driven on the basis of an audio signal; and a diaphragm that is coaxial with the cylindrical member, installed at the other end side of the cylindrical member, and vibrates in response to a sound wave that passes through the cylindrical member. While the cylindrical member functions as a resonance tube by being excited to vibration with the sound wave that is radiated from the sounding body and passes through the cylindrical member, the diaphragm functions as a passive radiator by vibrating in response to the sound wave passing through the cylindrical member.

While the cylindrical member functions as the resonance tube by being excited to vibration with the sound wave passing through the cylindrical member, the diaphragm functions as the passive radiator in response to the sound wave passing through the cylindrical member. Therefore, the output of sound in the lower range can be further enhanced than heretofore performed with excellent designability without making a significant change in the appearance of the cylindrical member or increasing the size thereof.

In the present invention, the sound wave radiated from the sounding body on the basis of the audio signal passes through the cylindrical member, the sounding body being coaxial with the cylindrical member opened on the one end side and the other end side and being arranged at the one end side of the cylindrical member. Also, in the present invention, the diaphragm that is coaxial with the cylindrical member and installed at the other end side of the cylindrical member functions as the passive radiator by vibrating in response to the sound wave that is radiated from the sounding body and passes through the cylindrical member.

While the cylindrical member functions as the resonance tube by being excited to vibration with the sound wave passing through the cylindrical member, the diaphragm functions as the passive radiator in response to the sound wave passing through the cylindrical member. Therefore, the output of sound in the lower range can be further enhanced than heretofore performed with excellent designability without making a significant change in the appearance of the cylindrical member or increasing the size thereof.

According to the present invention, the cylindrical member functions as the resonance tube by being excited to vibration with the sound wave passing through the cylindrical member, and the diaphragm functions as the passive radiator in response to the sound wave passing through the cylindrical member, thereby allowing the output of sound in the lower range to be further enhanced than heretofore without making a significant change in the appearance of the cylindrical member or increasing the size thereof. In this manner, the speaker apparatus and the audio output method can be realized, the speaker apparatus having the simple structure, the excellent designability and the satisfactory acoustic characteristics and capable of further enhancing the low pitch range without increasing the size.

MODE FOR CARRYING OUT THE INVENTION

Figure 1:
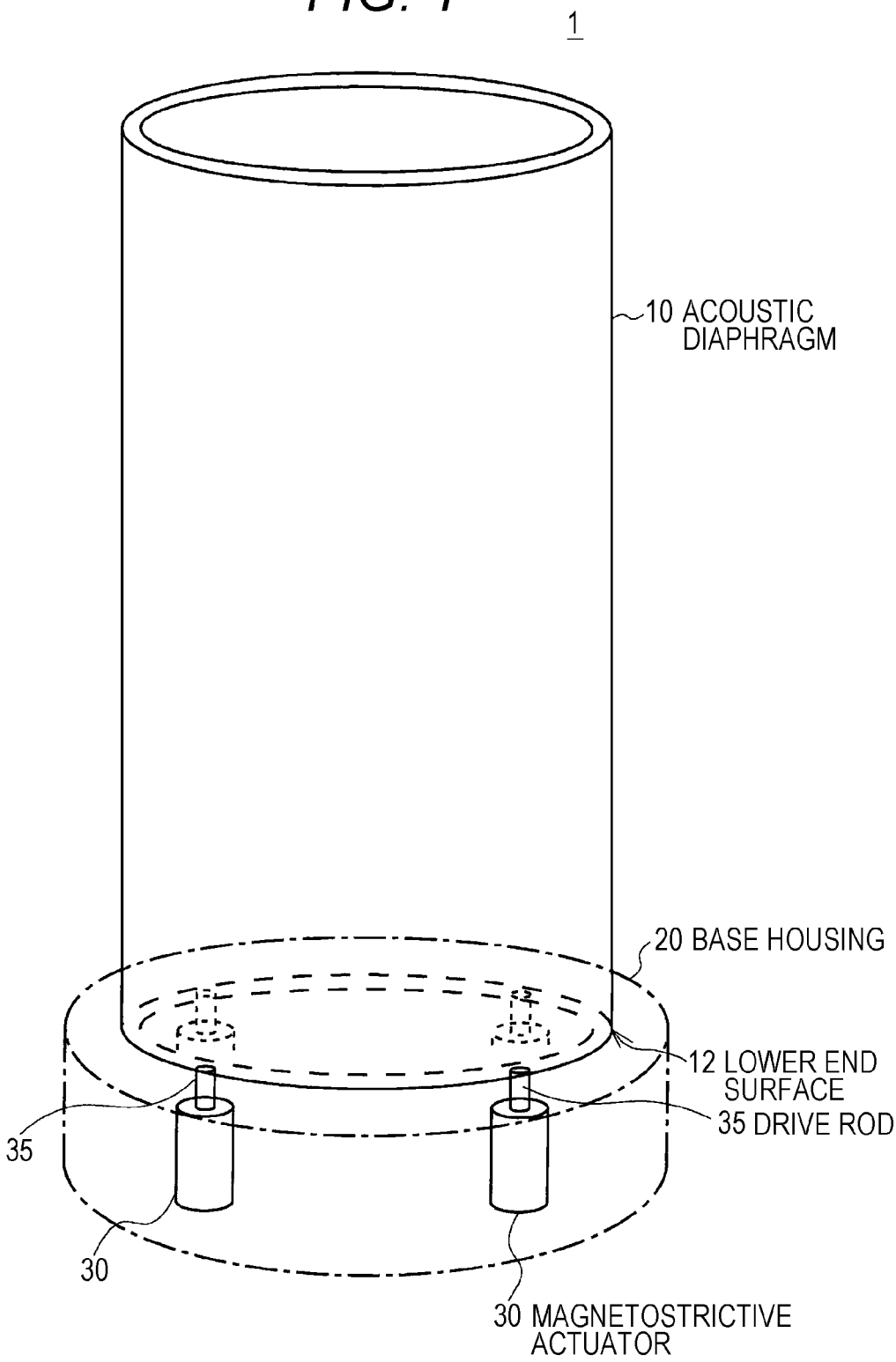
FIG. 1 is a schematic perspective view illustrating a construction of a conventional speaker system.

Modes for carrying out the invention will be described below in the following order.

1. Embodiment
2. Another Embodiment

<1. Embodiment>

[1-1. Structure of a Speaker Apparatus]

As shown in FIGS. 2 to 5, a speaker apparatus 100 includes a base housing 101, a pipe 102, a piezoelectric actuator 103, and a speaker unit 104 using an electric actuator (not shown) as a sounding body.

The base housing 101 is formed of a synthetic resin, for example, and is formed into a disk shape, a center part of which is provided with an opening 105 penetrating through the base housing in a cylindrical shape. The base housing 101 is also provided with three legs 106 planted at equal intervals along an outer circumference side of a bottom surface of the base housing, for example.

The base housing 101 can achieve stable installation by including three legs 106 as compared to four legs, for example, since these three legs 106 would be surely brought into contact with an installation surface.

Furthermore, the bottom surface of the base housing 101 can be separated from the installation surface by the legs 106 provided on the bottom surface of the base housing 101, thereby allowing a sound wave from the speaker unit 104 installed on the bottom surface side of the base housing 101 to be radiated outside.

The pipe 102 includes a cylindrical acoustic diaphragm and is formed of a transparent acrylic resin with a translucent property or a light-guiding property, for example. The pipe 102 is fixed to the base housing 101.

That is, the lower end of the pipe 102 is fixed to a top surface of the base housing 101 at a plurality of positions, four positions in the present embodiment, by using a metal L-shaped angle 107. The size of the pipe 102 here is 1000 mm in length, 120 mm in diameter, and 3 mm in thickness, for example.

Moreover, an outer frame 102A on the upper end surface of the pipe 102 (FIG. 3) is integrally adhered to a transparent edge-cum-diaphragm 102B of a predetermined thickness (approximately 0.3 mm) made of a urethane material by, for example, a transparent adhesive. The edge-cum-diaphragm 102B and the speaker unit 104 of the base housing 101 are disposed at positions to face each other.

As a result, the edge-cum-diaphragm 102B of the pipe 102 is adapted to function as a passive radiator for the speaker unit 104 of the base housing 101.

This transparent edge-cum-diaphragm 102B is attached to the transparent pipe 102 via the outer frame 102A on the upper end surface of the pipe 102 by the transparent adhesive, thereby maintaining transparency from the pipe 102 to the edge-cum-diaphragm 102B, constructing the appearance that can hardly be considered as a speaker, and allowing the designability to be improved as an interior accessory.

Incidentally, the outer frame 102A of the speaker apparatus 100 is also formed of a transparent acrylic resin so that a completely transparent state can be formed from the pipe 102 to the edge-cum-diaphragm 102B.

Here, the edge-cum-diaphragm 102B functioning as the passive radiator is constructed such that an edge part EG and a diaphragm part BC are formed integrally. Therefore, there is no need to individually tune the edge part and the diaphragm part after sticking them together, as conventionally performed. Simply, the edge-cum-diaphragm 102B as a whole needs tuning.

In this case, although not shown, a round hole for screwing is formed at one end and the other end of the L-shaped angle 107. One end of this L-shaped angle 107 is screwed to the top surface of the base housing 101 via a screw 109.

A screw groove (not shown) for being screwed together with a screwing part of the screw 109 is formed on the base housing 101. In this case, a damping material 108 formed of a ring-shaped rubber material or the like is interposed between the one end of the L-shaped angle 107 and the top surface of the base housing 101.

Furthermore, the other end of the L-shaped angle 107 is screwed to the lower end of the pipe 102 through a screw 110 and a nut 111. A round hole (not shown) for passing a screwing part of the screw 110 is formed at the lower end of the pipe 102.

Damping materials 112 and 113 formed of a ring-shaped rubber material or the like are interposed between the other end of the L-shaped angle 107 and the outer surface of the pipe 102, and between the nut 111 and the inner surface of the pipe 102, respectively.

In the speaker apparatus 100, the damping materials 108, 112, and 113 interposed in this manner would inhibit vibration (an elastic wave) by the piezoelectric actuator 103 from being propagated into the base housing 101 through the pipe 102 and the L-shaped angle 107, thereby preventing the audio image from being localized to the side of the base housing 101.

In this speaker apparatus 100, moreover, four piezoelectric actuators 103 are fixed to the base housing 101 and disposed at equal intervals along the circular end surface at the lower end side of the pipe 102. The piezoelectric actuator 103 is driven by voltage, and a drive rod 103A thereof includes a transmission part for transmitting a displacement output.

In this case, a storage hole 114 for storing the piezoelectric actuator 103 is formed in the base housing 101, and the piezoelectric actuator 103 is fixed to the base housing 101 by being stored in this storage hole 114.

Four piezoelectric actuators 103 are used in the present embodiment. However, a current-driven magnetostrictive actuator or an electrodynamic actuator may also be used, for example.

The speaker apparatus 100 in this case uses the voltage-driven piezoelectric actuators 103 and thus consumes less electric current than the current-driven actuator, which would result in advantages of less amount of heat generated and a longer service life of a battery.

Here, a damping material 115 formed of a rubber material or the like is interposed between the base of the storage hole 114 and the piezoelectric actuator 103, thereby inhibiting the vibration by the piezoelectric actuator 103 from being propagated into the base housing 101 and preventing the audio image from being localized to the side of the base housing 101.

The drive rod 103A of the piezoelectric actuator 103 would be in a state abutting on the end surface of the pipe 102 on the lower end side thereof when the piezoelectric actuator 103 is stored and fixed to the storage hole 114 of the base housing 101.

In this case, a displacement direction of the drive rod 103A is also a planar direction (a direction parallel to the surface) of the pipe 102. In the speaker apparatus 100, the pipe 102 can be vibrated from the end surface on the lower end side thereof with the vibration component directed orthogonal to the end surface, by means of the piezoelectric actuators 103 arranged in the above manner.

At this time, the end surface on the lower end side of the pipe 102 is excited by a longitudinal wave, which mixes with a transverse wave to be a mixed wave by the propagation of a vibration elastic wave in the planar direction (the direction parallel to the surface) of the pipe 102, whereby the mixed wave is radiated in the planar direction of the pipe 102 to form a uniform audio image across the entire height direction of the pipe 102.

In this manner, the pipe 102 includes a speaker in charge of an upper range side of an audible frequency range to function as a tweeter, the speaker unit 104 includes a speaker in charge of a lower range side of the audible frequency range to function as a woofer, and the edge-cum-diaphragm 102B functions as the passive radiator that enhances a low-pitched sound from the speaker unit 104.

The speaker unit 104 is installed by using a screw (not shown), for example, in a position corresponding to the opening 105 on the bottom surface side of the base housing 101 while facing downward. In this case, a central axis of the speaker unit 104 is directed in the same way as an axis of the pipe 102.

The sound wave of a positive phase output from the front of this speaker unit is radiated outside from the bottom surface side of the base housing 101. When the sound wave of a negative phase output from the rear surface of the speaker unit 104 reaches the edge-cum-diaphragm 102B through the opening 105 and the pipe 102, the pipe 102 functions as a resonance tube to output heavy lower range sound and, at the same time, the edge-cum-diaphragm 102B functions as the passive radiator.

In this case, the speaker apparatus 100 can further enhance the lower range sound by including both the function as the resonance tube by means of the pipe 102 and the function as the passive radiator by means of the edge-cum-diaphragm 102B.

Also, a damping material 116 formed of a rubber material or the like is arranged between the end surface on the lower end side of the pipe 102 and the base housing 101. As shown in FIG. 4(B), the damping material 116 is formed in a ring shape as a whole and provided with a through-hole 116A for passing therethrough the drive rod 103A of the piezoelectric actuator 103.

Therefore, in the speaker apparatus 100, the damping material 116 would prevent the vibration by the piezoelectric actuator 103 from being propagated into the base housing 101 through the pipe 102. At the same time, the pipe 102 can satisfactorily function as the resonance tube with the increased airtightness provided by the damping material 116.

In addition to such construction, the speaker apparatus 100 (FIGS. 3 and 4) includes a total of six LED (Light Emitting Diode) light bulbs 132 installed at 60-degree intervals on stays 131 arranged to cover the rear surface side of the speaker unit 104, on the rear surface side of the speaker unit 104 installed to the opening 105 of the base housing 101. Note that the LED light bulb 132 may simply be an LED.

In addition, the speaker apparatus 100 is provided with a substantially discoid diffuser panel 133 installed on a driver part 104D of the speaker unit 104 so as to cover the LED light bulb 132.

Consequently, the speaker apparatus 100 is adapted to irradiate the edge-cum-diaphragm 102B from inside after diffusing irradiation light from the LED light bulb 132 with a diffuser panel 133 and making the irradiation light pass through the pipe 102 as diffused light.

The edge-cum-diaphragm 102B is also a diaphragm with a light-diffusing property, that is, a light-diffuser panel. The diffused light having passed through the pipe 102 is further diffused by the edge-cum-diaphragm 102B and then radiated outside.

Functioning as the passive radiator, the edge-cum-diaphragm 102B vibrates in synchronization with the low-pitched sound output from the speaker unit 104. As a result, the speaker apparatus 100 forms a light emission state in which the sound from the speaker unit 104 and from the vibration of the edge-cum-diaphragm 102B is synchronized with the light radiated in conjunction with the vibration of the edge-cum-diaphragm 102B.

Here, the pipe 102 is formed of an acrylic resin with a translucent property or a light-guiding property but may also contain a fluorescent paint.

For example, a fluorescent paint for plastics named Lumogen F (registered trademark) Dyes by BASF Corporation may be used as the fluorescent paint.

In effect, the pipe 102 would concentrate light on the entire surface thereof and emit strong fluorescence from the edge (the end surface) by containing the fluorescent paint of approximately 0.02% of the mass of the acrylic resin forming the pipe 102.

The Lumogen F (registered trademark) Dyes include Orange240 (trade name), Yellow083 (trade name), Red305 (trade name) and the like.

When Orange240 (trade name) is used, for example, the entire pipe 102 would appear transparent orange, and the upper end surface thereof (shielded by the outer frame 102A in this case) would intensely glow orange.

Moreover, when a letter is scratched and traced on the outer side surface of the pipe 102, the letter portion would glow intensely. This letter portion would glow by an external fluorescence light, the sunlight or the like without turning on the LED light bulb 132.

Therefore, the speaker apparatus 100 is adapted such that a user can easily visually recognize the letter portion traced on the pipe 102 under the operating environment in which the external light is provided to the pipe 102 even when the LED light bulb 132 is turned off.

The Lumogen F (registered trademark) Dyes are also superior in light resistance (a residual ratio of fluorescence). The pipe 102 containing Orange240 (trade name) with fluorescence intensity of 100 before exposure would have the fluorescence intensity of 85 after being exposed for 2000 hours under a certain condition.

[1-2. A Method for Driving a Speaker]

Next, a drive system of the speaker apparatus 100 will be described. In this speaker apparatus 100, the four piezoelectric actuators 103 are independently provided with drive signals that have no mutual correlation in order to expand the audio image outside the pipe 102. A principle of this will be described with a case where two actuators are used.

Figure 6:
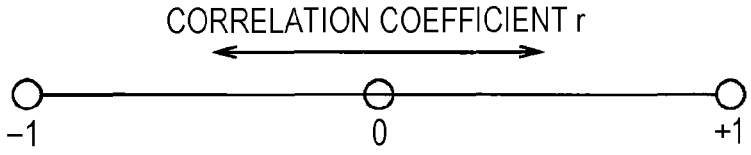
FIG. 6 is a schematic view used to describe a correlation coefficient.

Now, there is an index called a correlation coefficient r for indicating a degree of similarity between two audio signals, for example. As shown in FIG. 6, the correlation coefficient r takes a value from +1 to −1.

Specifically, the correlation coefficient r would be 1 (+1) when the two audio signals are completely identical, would be 0 when the two audio signals are independent or unrelated, and would be −1 when the two audio signals are in mutually opposite phases.

Figure 7:
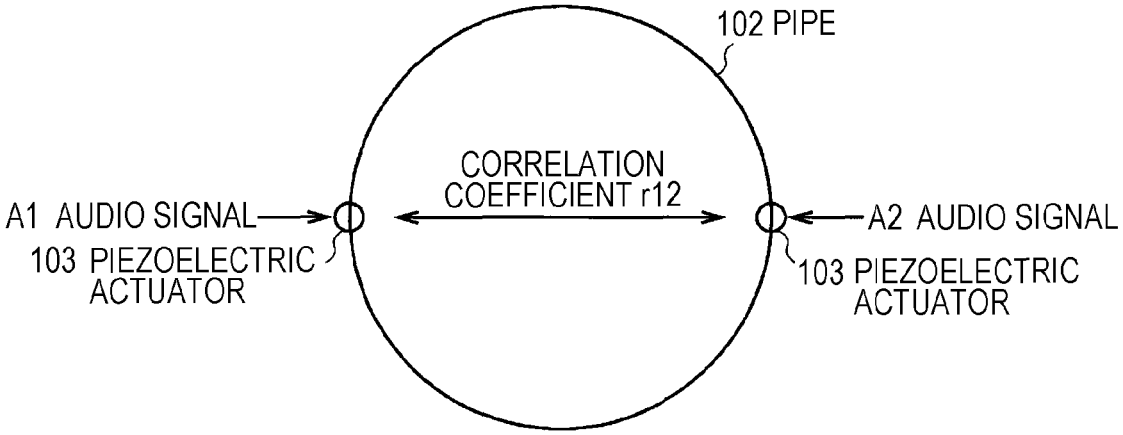
FIG. 7 is a schematic view illustrating a correlation coefficient when there are two actuators.

In effect, as shown in FIG. 7, an audio signal for driving the piezoelectric actuator 103 on the left side is let to be A1, an audio signal for driving the piezoelectric actuator 103 on the right side is let to be A2, and the correlation coefficient between the audio signals A1 and A2 is let to be r12, when vibration is to be added to the lower end surface of the cylindrical pipe 102 by the piezoelectric actuator 103 in a planar direction perpendicular to the lower end surface of the pipe.

Figure 8:
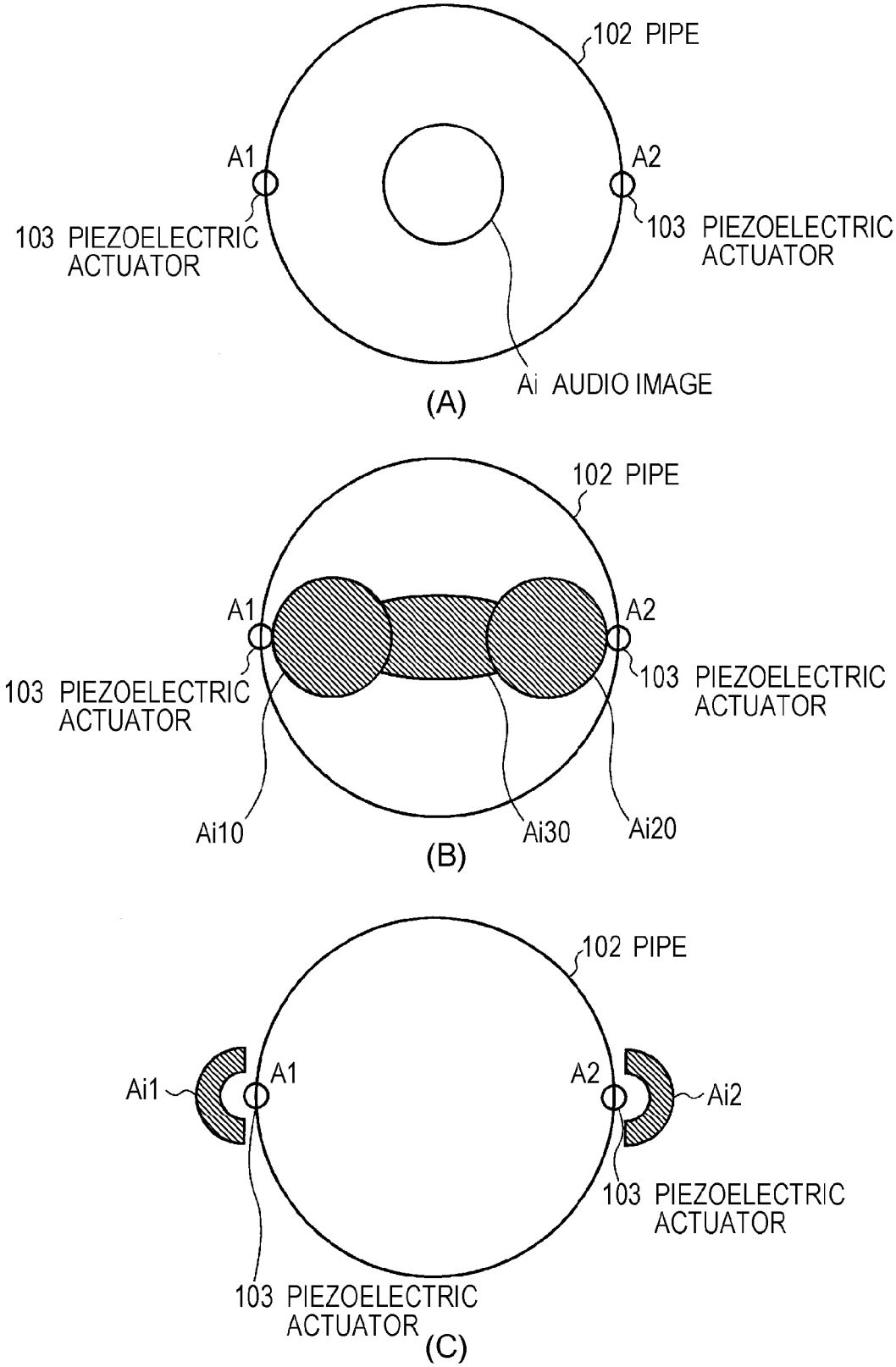
FIG. 8 is a set of schematic views illustrating a change in an audio image according to a correlation coefficient between two audio signals, where r12=1 in FIG. 8(A), r12=0 in FIG. 8(B), and r12=−1 in FIG. 8(C).

Considering the relationship between the correlation coefficient r12 and the audio image, as shown in FIG. 8(A), an audio image Ai would be formed in the central part inside the pipe 102 within a surface orthogonal to the central axis of the pipe 102 when the correlation coefficient is r12=1. There would be no sense of spread in the audio image.

Specifically, the audio signals A1 and A2 would each be a synthesized signal obtained by the sum of a left audio signal and a right audio signal of a stereo audio signal when the correlation coefficient is r12=1, for example.

When the correlation coefficient is r12=0, the audio image Ai would include, within the surface orthogonal to the central axis of the pipe 102, circular audio image portions Ai10 and Ai20 inside the piezoelectric actuators 103 on the left side and the right side, respectively, and an audio image portion Ai30 between the circular audio image portions Ai10 and Ai20, as shown in FIG. 8(B).

Specifically, the audio signal A1 would be the left audio signal of the stereo audio signal, and the audio signal A2 would be the right audio signal of the stereo audio signal when the correlation coefficient is r12=0, for example.

When the correlation coefficient is r12=−1, the audio image Ai would include, within the surface orthogonal to the central axis of the pipe 102, semi-circular audio image portions Ai1 and Ai2 outside the piezoelectric actuators 103 on the left side and the right side, respectively, as shown in FIG. 8(C). There would be a sense of spread in the audio image Ai.

Specifically, the audio signal A1 would be the synthesized signal obtained by the sum of the left audio signal and the right audio signal of the stereo audio signal, and the audio signal A2 would be a signal in a phase opposite from that of the audio signal A1 when the correlation coefficient is r12=−1, for example.

Accordingly, in the speaker apparatus 100, the two piezoelectric actuators 103 are independently driven by the two audio signals A1 and A2 made non-correlated so that the correlation coefficient r12 of the audio signals would be less than 1. The non-correlation is achieved by performing phase shift, delay or arithmetic operation (synthesis) on the audio signals.

[1-3. A Drive Method and an Audio Image State]

Figure 9:
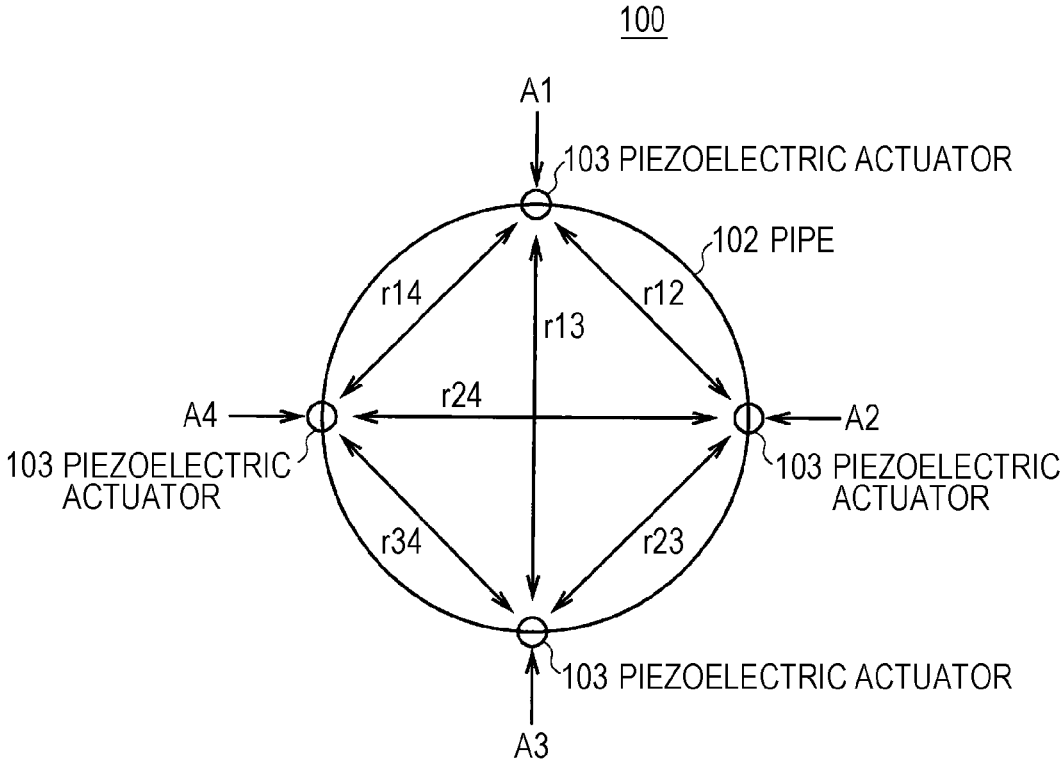
FIG. 9 is a schematic view illustrating correlation coefficients when there are four actuators.

As shown in FIG. 9, the speaker apparatus 100 in the present embodiment includes a piezoelectric actuator 103 on the upper side and a piezoelectric actuator 103 on the lower side in addition to the piezoelectric actuators 103 on the left and right sides.

In this case, let the audio signal for driving the piezoelectric actuator 103 on the upper side be A1, the audio signal for driving the piezoelectric actuator 103 on the right side be A2, the audio signal for driving the piezoelectric actuator 103 on the lower side be A3, and the audio signal for driving the piezoelectric actuator 103 on the left side be A4.

Then, there would be six correlation coefficients r including: the correlation coefficient r12 between the audio signals A1 and A2; a correlation coefficient r13 between the audio signals A1 and A3; a correlation coefficient r14 between the audio signals A1 and A4; a correlation coefficient r23 between the audio signals A2 and A3; a correlation coefficient r24 between the audio signals A2 and A4; and a correlation coefficient r34 between the audio signals A3 and A4.

The audio signals A1, A2, A3, and A4 are processed to be mutually non-correlated such that these six correlation coefficients r12, r13, r14, r23, r24, and r34 would all be sufficiently smaller than 1, namely, a value close to −1 or 0.

As a result, as shown in FIGS. 10(A) and 10(B), the audio image Ai by the audio signals A1, A2, A3, and A4 of the speaker apparatus 100 would be formed into a ring shape as a whole on the outer side of the pipe 102 within the surface orthogonal to the central axis of the pipe 102, thereby obtaining the sense of spread from the audio image.

Specific methods of driving a speaker when performing the monaural reproduction, the stereo reproduction, and the surround reproduction will be described below.

[1-4. A Drive Method when Performing the Monaural Reproduction]

Figure 11:
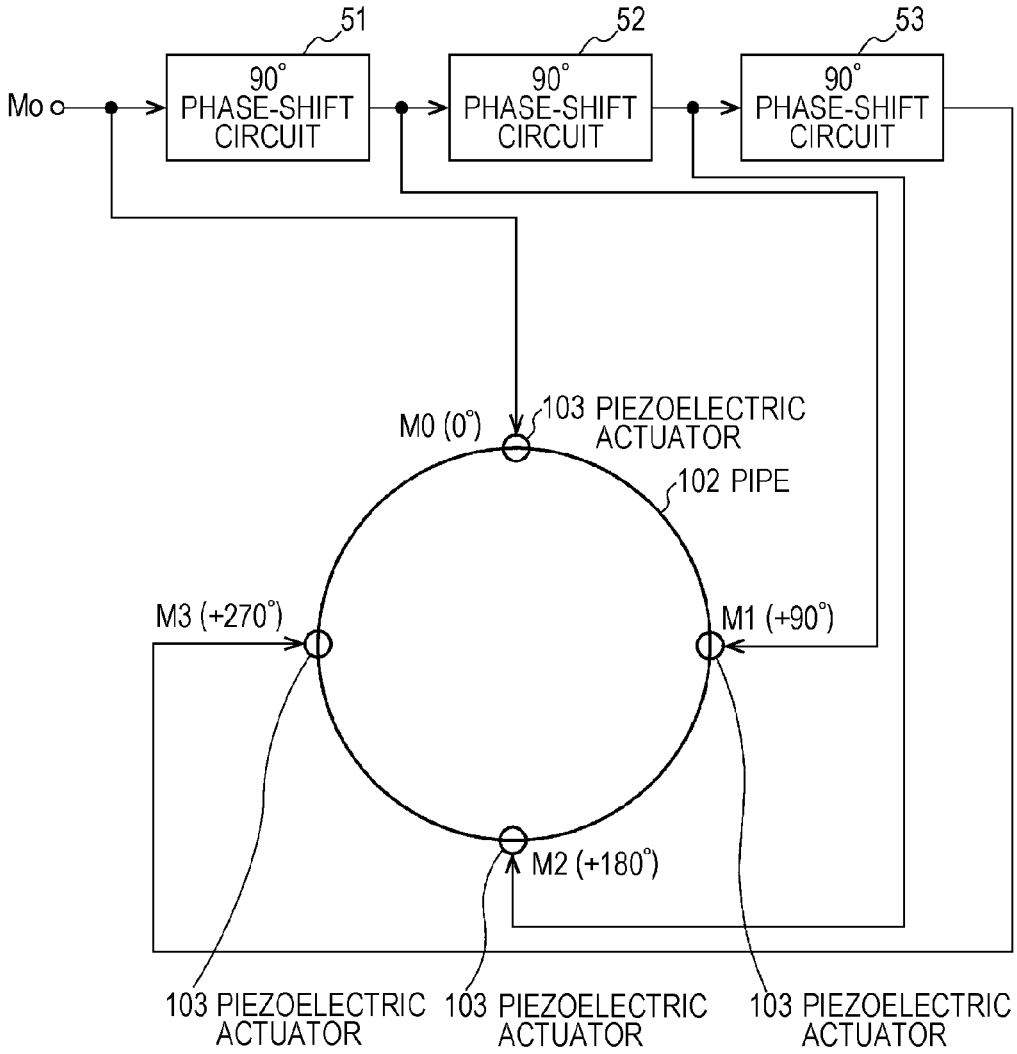
FIG. 11 is a schematic view illustrating one example of a drive method when performing monaural reproduction.

As a drive method when performing the monaural reproduction, audio signals are made non-correlated by shifting a phase of an audio signal, as shown in FIG. 11.

Specifically, in this drive method, an original monaural audio signal Mo is supplied to the piezoelectric actuator 103 on the upper side as is, and the phase of the monaural audio signal Mo is delayed (or advanced) 90° by a 90° phase-shift circuit 51 to be supplied to the piezoelectric actuator 103 on the right side as a monaural audio signal M1.

Then, in this drive method, the phase of the monaural audio signal M1 is delayed (or advanced) 90° by a 90° phase-shift circuit 52 to be supplied to the piezoelectric actuator 103 on the lower side as a monaural audio signal M2, the phase of which is then delayed (or advanced) 90° by a 90° phase-shift circuit 53 to be supplied to the piezoelectric actuator 103 on the left side as a monaural audio signal M3.

Figure 10:
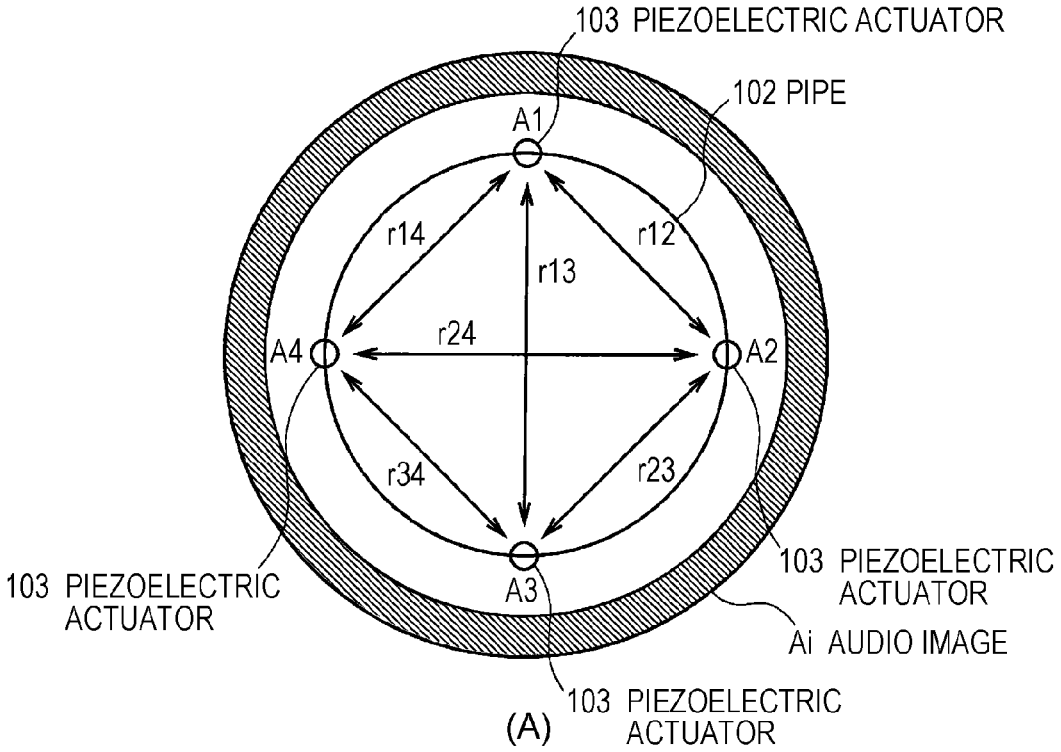
FIG. 10(A) is a schematic view illustrating one example of an audio image state when viewed from above, and FIG. (B) is a schematic view illustrating one example of the audio image state when viewed obliquely from a side.
Figure 10:
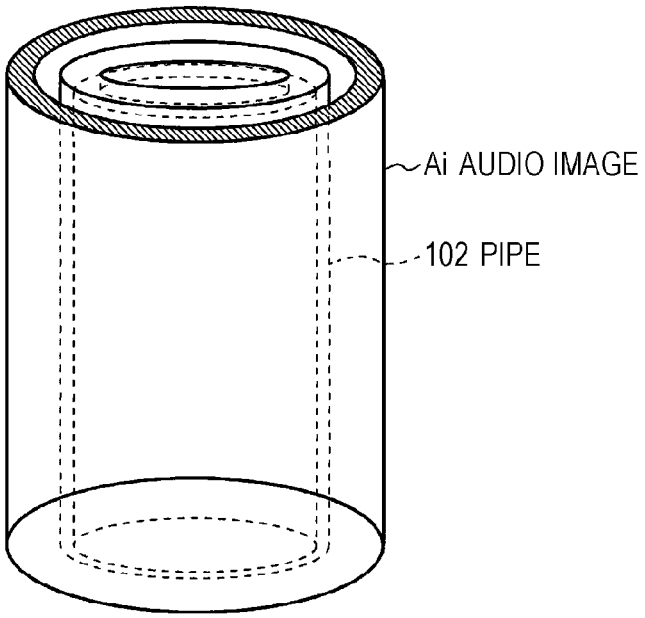

In this drive method, as shown in FIG. 9, the six correlation coefficients r12, r13, r14, r23, r24, and r34 are all made non-correlated and, as shown in FIG. 10, the audio image Ai with a sense of spread is formed on the outer side of the pipe 102.

[1-5. A Drive Method when Performing the Stereo Reproduction]

Figure 12:
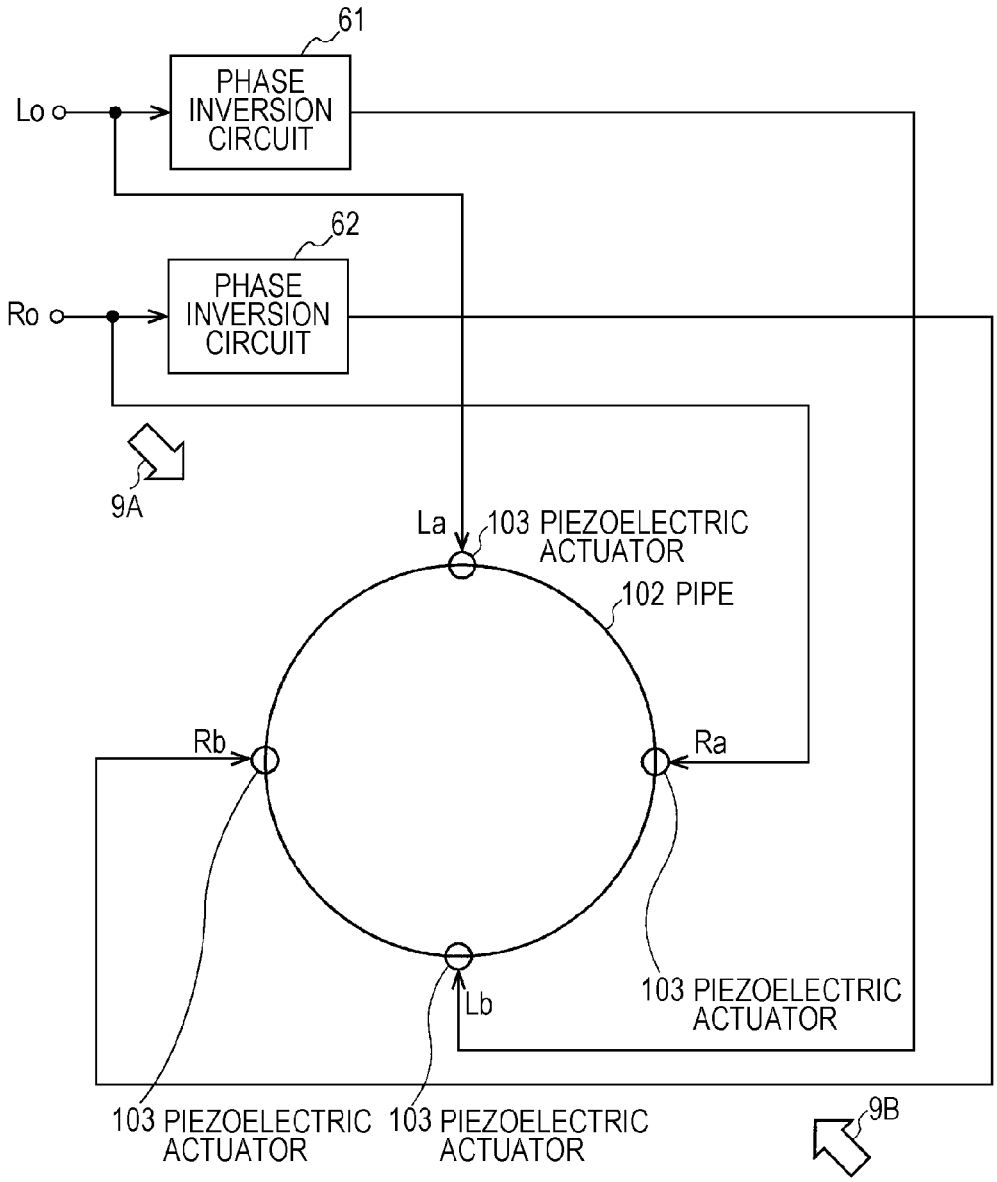
FIG. 12 is a schematic view illustrating one example of a drive method when performing stereo reproduction.

As a drive method when performing the stereo reproduction, audio signals are made non-correlated by inverting a phase of an audio signal as shown in FIG. 12, for example.

Specifically, in this drive method, an original left audio signal Lo is directly supplied to the piezoelectric actuator 103 on the upper side as one left audio signal La, and the phase of the left audio signal Lo is inverted by a phase inversion circuit 61 to obtain another left audio signal Lb, the phase of which is inverted from that of the one left audio signal La. The left audio signal Lb is then supplied to the piezoelectric actuator 103 on the lower side.

Likewise, in this drive method, an original right audio signal Ro is directly supplied to the piezoelectric actuator 103 on the right side as one right audio signal Ra, and the phase of the right audio signal Ro is inverted by a phase inversion circuit 62 to obtain another right audio signal Rb, the phase of which is inverted from that of the one right audio signal Ra. The right audio signal Rb is then supplied to the piezoelectric actuator 103 on the left side.

Thus, in this drive method, the correlation coefficient r13 (FIG. 9) between the left audio signals La and Lb would be −1, and the correlation coefficient r24 between the right audio signals Ra and Rb would also be −1, thereby forming the audio image Ai with the sense of spread on the outer side of the pipe 102.

In this drive method, a listener can listen to music such that the left audio signal is positioned on the left side seen from the listener and the right audio signal is positioned on the right side seen from the listener, even when the listener listens to the music from a direction shown by an arrow 9A or an arrow 9B.

When the listener listens from a fixed direction, however, the left audio signals La and Lb may be supplied to the mutually adjacent piezoelectric actuators 103 on the upper and right sides, and the right audio signals Ra and Rb may be supplied to the mutually adjacent piezoelectric actuators 103 on the lower and left sides.

Incidentally, other drive methods when performing the stereo reproduction include: an example of shifting the phase of the audio signal by 90° to achieve the non-correlation; an example of delaying (or advancing) the phase of the audio signal by 90° to achieve the non-correlation; an example of delaying the audio signal by a predetermined amount of time to achieve the non-correlation; an example of achieving the non-correlation by two comb filters having mutually complementary frequency characteristics; and an example of achieving the non-correlation by a Schroeder circuit.

[1-6. A Drive Method when Performing the Surround Reproduction]

Figure 13:
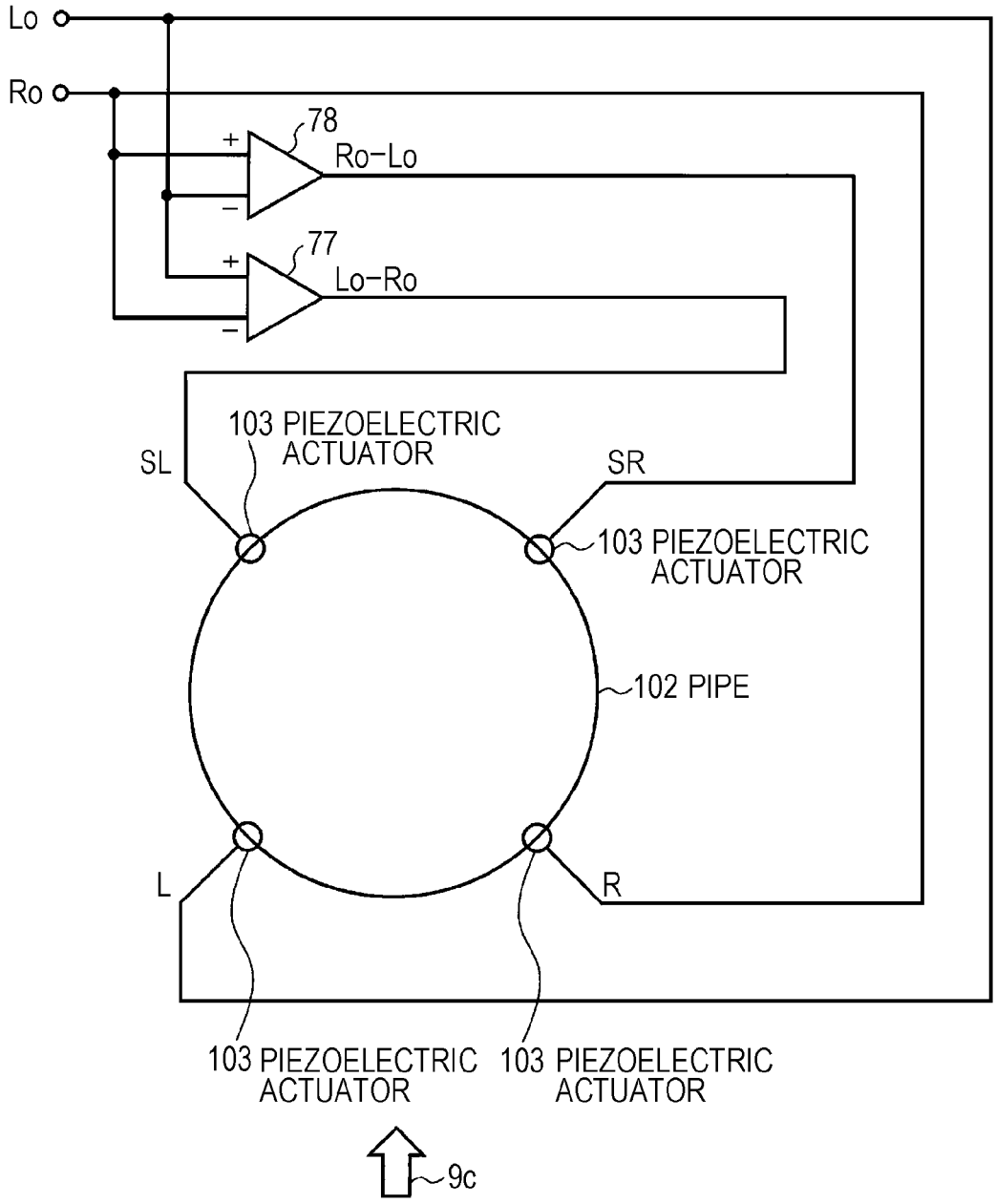
FIG. 13 is a schematic view illustrating one example of a drive method when performing surround reproduction.

In a drive method when performing the surround reproduction, an original left audio signal Lo is directly supplied to the piezoelectric actuator 103 on the lower left side as a left audio signal L, and an original right audio signal Ro is directly supplied to the piezoelectric actuator 103 on the lower right side as a right audio signal R, as an example shown in FIG. 13.

At the same time, a signal (Lo−Ro) non-correlated to each of the left audio signal L (Lo) and the right audio signal R (Ro) is obtained by subtracting the right audio signal Ro from the left audio signal Lo by an arithmetic circuit 77. This signal (Lo−Ro) is then supplied to the piezoelectric actuator 103 on the upper left side as a surround left audio signal SL.

Likewise, a signal (Ro−Lo) non-correlated to each of the left audio signal L (Lo) and the right audio signal R (Ro) is obtained by subtracting the left audio signal Lo from the right audio signal Ro by an arithmetic circuit 78. This signal (Ro−Lo) is then supplied to the piezoelectric actuator 103 on the upper right side as a surround right audio signal SR.

The surround right audio signal SR would also be non-correlated to the surround left audio signal SL, that is, the surround left audio signal SL and the surround right audio signal SR would be mutually non-correlated.

Figure 14:
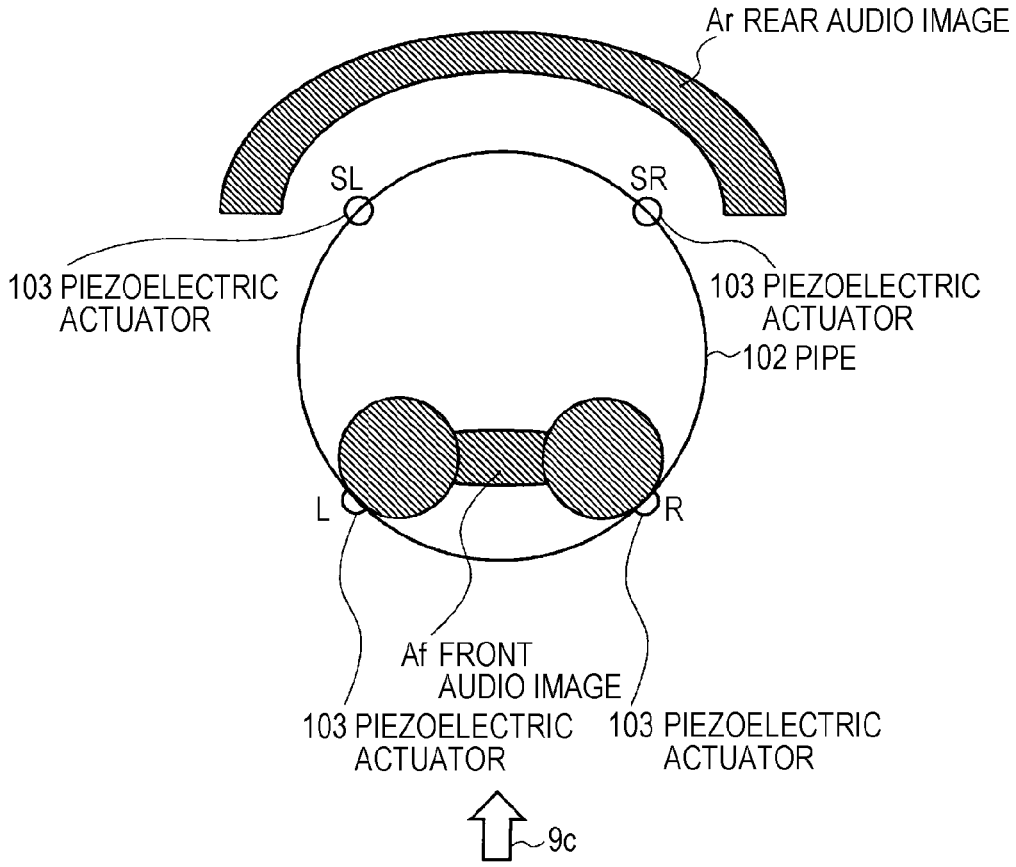
FIG. 14 is a schematic view illustrating an audio image state when the surround reproduction is performed.

In effect, a front audio image Af is formed inside the pipe 102 between the piezoelectric actuators 103 on the lower left side and the lower right side when the listener listens to acoustic sound being reproduced from a direction shown by an arrow 9*c*, as shown in FIG. 14.

On the other hand, a rear audio image Ar is formed outside the pipe 102 from the vicinity of the piezoelectric actuator 103 on the upper left side to the vicinity of the piezoelectric actuator 103 on the upper right side. The front audio image Af and the rear audio image Ar together would make it multidirectional as a whole.

Note that the drive method when performing the surround reproduction is not limited to the aforementioned method but can also be used by means of various other methods.

[1-7. Operation of a Speaker Apparatus]

Now, operation of the speaker apparatus 100 (FIGS. 2 to 5) will be described.

In the speaker apparatus 100, the four piezoelectric actuators 103 stored and fixed to the base housing 101 are driven by the four kinds of audio signals that are mutually non-correlated, the individual drive rods 103A are displaced in response to the respective audio signals, and the pipe 102 is vibrated by the vibration component from the end surface on the lower end side of the pipe 102 in a direction orthogonal to the end surface (a planar direction).

At this time, the end surface on the lower end side of the pipe 102 is excited to vibration by the longitudinal wave, and the elastic wave (vibration) is propagated into the pipe 102 in the planar direction. This elastic wave repeats a mode conversion of the longitudinal wave, the transverse wave, the longitudinal wave, to be the mixed wave of the longitudinal wave and the transverse wave when being propagated into the pipe 102. The vibration in an in-plane direction of the pipe 102 (a direction perpendicular to the surface) is excited by the transverse wave and, as a result, the speaker apparatus 100 radiates the sound wave from the pipe 102.

That is, the speaker apparatus 100 can obtain sound in a high pitch range output from the outer surface of the pipe 102.

In this speaker apparatus 100, the four piezoelectric actuators 103 arranged at equal intervals along the circular end surface on the lower end side of the pipe 102 are driven by the four audio signals that are mutually non-correlated, thereby forming the ring-shaped audio image on the outer side of the pipe 102. As a result, a user can obtain the sense of wide spread from the audio image.

Figure 15:
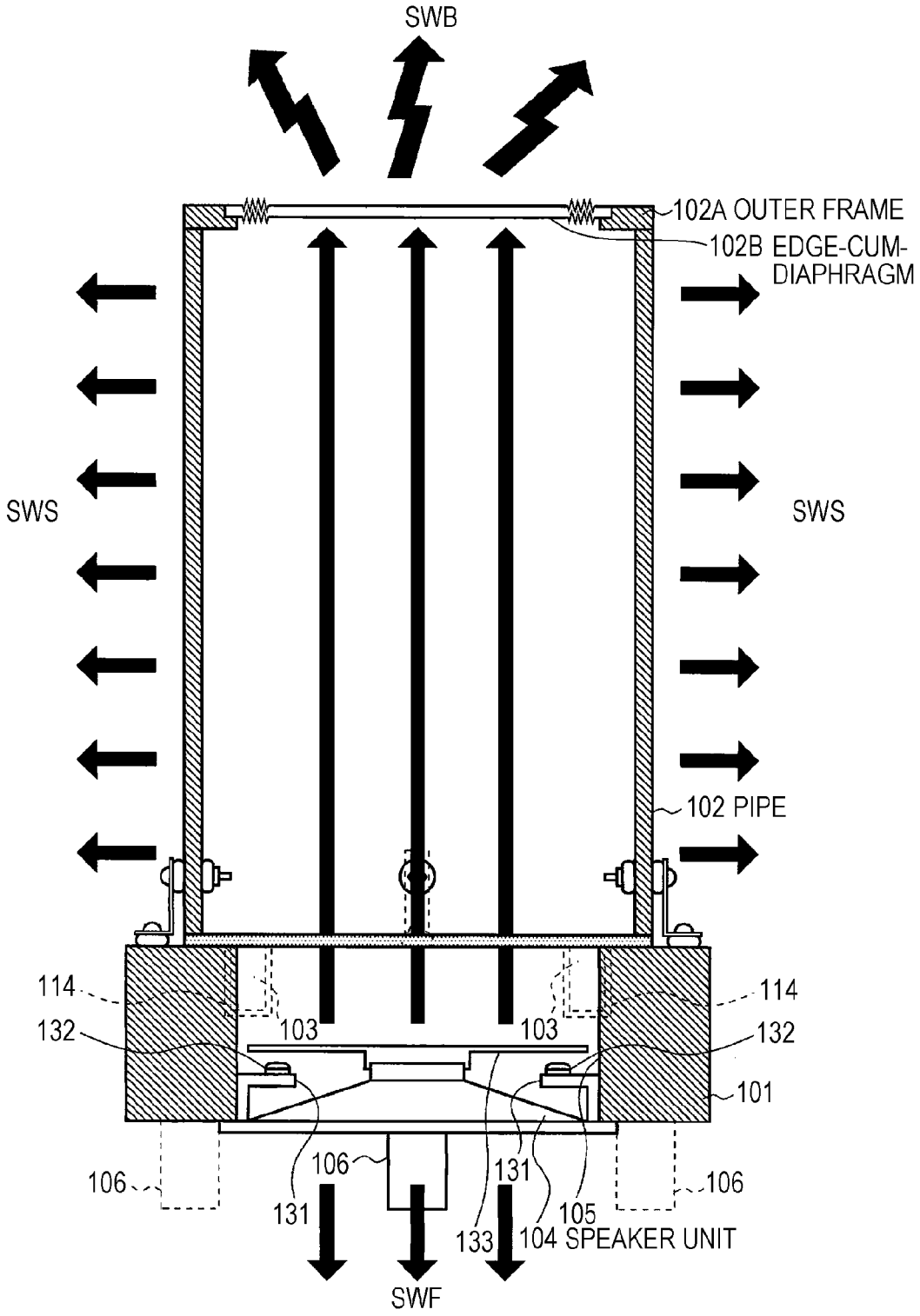
FIG. 15 is a schematic view provided to describe a state of sound wave radiation.

Also in the speaker apparatus 100, as shown in FIG. 15, a sound wave SWF of a positive phase can be obtained by a lower range component of the audio signal from the front surface of the speaker unit 104 installed on the bottom surface side of the base housing 101, and a sound wave SWB of a negative phase can be obtained by the lower range component of the audio signal from the back surface of the speaker unit.

The sound wave SWF obtained from the front surface of the speaker unit 104 is radiated outward from the bottom surface side of the base housing 101. In addition, the sound wave SWB obtained from the back surface of the speaker unit 104 passes through the opening 105 and the pipe 102 to approach the edge-cum-diaphragm 102B installed on the upper end surface.

This pipe 102 is formed light and thin to the extent the pipe can be excited to vibration by the sound wave SWB. As a result, the pipe wall of the pipe 102 is excited to vibration by the sound wave of the negative phase (air density) SWB passing through the pipe 102.

The pipe wall of the pipe 102 is excited to vibration in response to the sound wave SWB of the negative phase to function as the resonance tube, whereby a sound wave SWS of the positive phase is radiated outward from the entire outer surface of the pipe 102, the sound wave SWS corresponding to the audio signal associated with driving the speaker unit 104. Consequently, a user can feel uniform sound pressure at each position in a longitudinal direction of the pipe 102 and obtain the audio image that is spread throughout the pipe 102.

In this speaker apparatus 100, the upper part of the pipe 102 is closed by the edge-cum-diaphragm 102B. Therefore, a sound wave of the negative phase (not shown), which is generated inside the pipe 102 when the pipe vibrates in response to the sound wave SWB of the negative phase, would be confined inside the pipe 102 and not be radiated outside.

As a result, the speaker apparatus 100 can eliminate in advance an adverse influence of the sound wave of the negative phase with respect to the sound wave SWS of the positive phase that is radiated outside from the entire outer surface of the pipe 102, thereby allowing satisfactory acoustic characteristics to be obtained as compared to the case where the edge-cum-diaphragm 102B is not installed.

In the speaker apparatus 100, moreover, the edge-cum-diaphragm 102B as the passive radiator vibrates in response to the sound wave SWB heading outside from the rear surface of the speaker unit 104 through the opening 105 and the pipe 102. In consequence, the sound wave SWB with the further enhanced low pitch range would be radiated outside through the edge-cum-diaphragm 102B.

Accordingly, the speaker apparatus 100 can output low-pitched sound that is further enhanced compared to conventional devices by means of the sound wave SWS radiated outside from the entire outer surface of the pipe 102 and the sound wave SWB radiated outside through the edge-cum-diaphragm 102B as the passive radiator.

That is to say, the speaker apparatus 100 can obtain: sound in a high pitch range output from the outer surface of the pipe 102 by the vibration added from the four piezoelectric actuators 103; sound in the low pitch range output from the entire outer surface of the pipe 102 by the pipe wall thereof being vibrated by the sound wave SWB of the negative phase from the speaker unit 104 and functioning as the resonance tube; and sound in the further enhanced low pitch range output by the edge-cum-diaphragm 102B functioning as the passive radiator by the sound wave SWB of the negative phase from the speaker unit 104.

[1-8. Characteristics Caused by the Passive Radiator]

In the speaker apparatus 100 (FIGS. 2 and 3), the edge-cum-diaphragm 102B is installed as the passive radiator on the upper end surface of the pipe 102. Here, the difference in frequency characteristics between the cases where the passive radiator is and is not actually installed will be examined.

Figure 16:
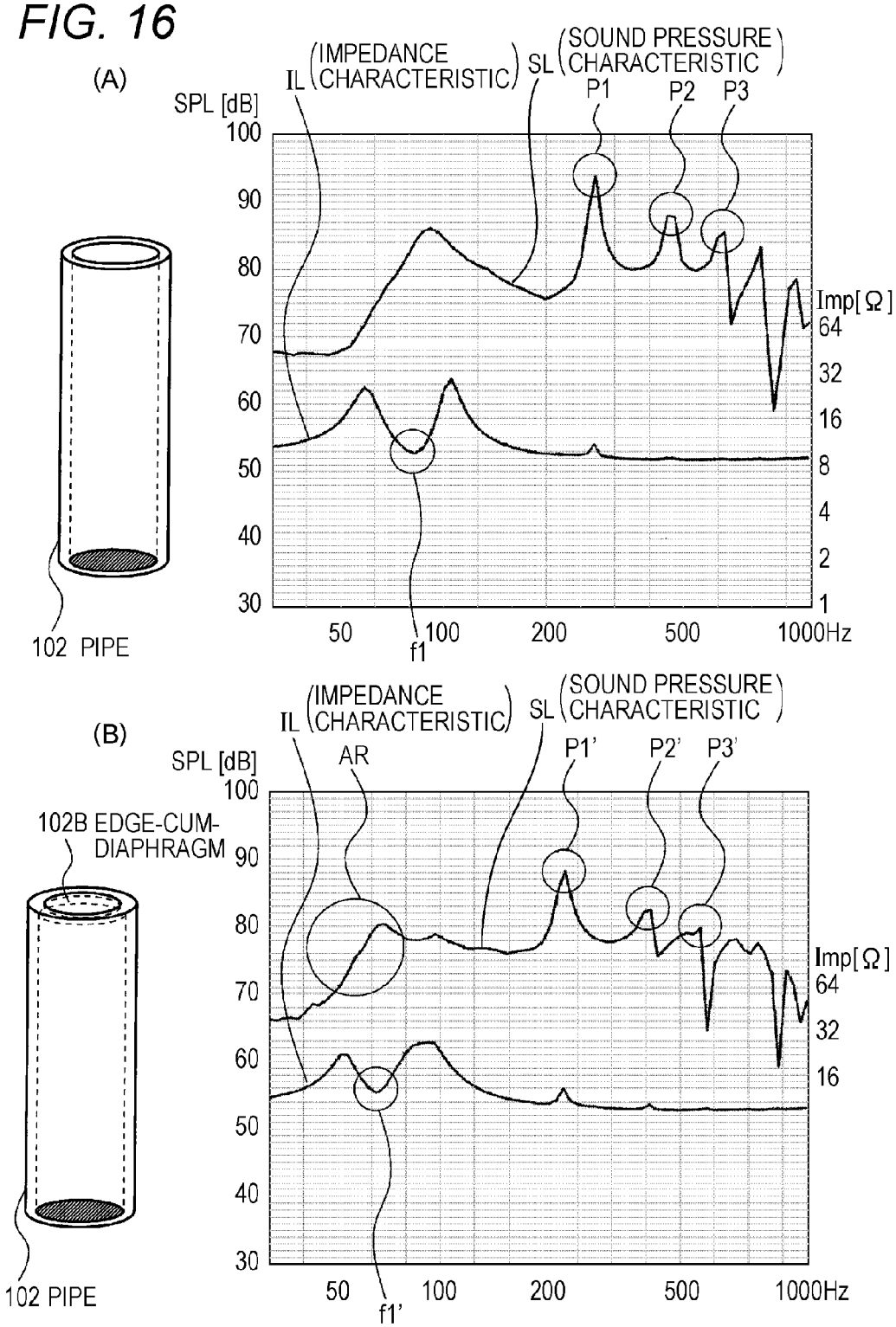
FIG. 16(A) is a schematic view illustrating characteristics without a passive radiator.
FIG. 16(B) is a schematic view illustrating the characteristics with a passive radiator. These are schematic views.

As shown in FIG. 16(A), a sound pressure characteristic SL and an impedance characteristic IL will have patterns shown in a graph when the passive radiator (the edge-cum-diaphragm 102B) is not installed to the pipe 102 of the speaker apparatus 100.

As for the impedance characteristic IL, in this case, a frequency f1 (approximately 80 Hz) at a trough portion called a dip would be the resonance point for the entire pipe 102.

At this time, with regards to the sound pressure characteristic SL, a first resonance occurs at the resonance point, and high-order resonances including a third, a fifth and a seventh resonance occur at a frequency P1 around about 240 Hz, a frequency P2 around about 400 Hz, and a frequency P3 of about 560 Hz, respectively.

On the other hand, as shown in FIG. 16(B), the sound pressure characteristic SL and the impedance characteristic IL will have patterns shown in a graph when the passive radiator (the edge-cum-diaphragm 102B) is installed to the pipe 102 of the speaker apparatus 100.

In this case, as for the impedance characteristic IL, a frequency f1' (approximately 65 Hz) at a dip would be the resonance point for the entire pipe 102 and the edge-cum-diaphragm 102B. As for the sound pressure characteristic SL, the first resonance occurs in an area AR that includes a frequency band of the resonance point.

That is, as for the sound pressure characteristic SL, the frequency band of the resonance point lowered from the frequency f1 (approximately 80 Hz) to the frequency f1' (approximately 65 Hz) has allowed for the sound in the still lower pitch range to be reproduced, indicating that its sound pressure level has also been increased.

With respect to the sound pressure characteristic SL, moreover, the high-order resonances including the third, fifth and seventh resonances occur at a frequency P1' around about 205 Hz, a frequency P2' around about 340 Hz, and a frequency P3' of about 500 Hz, respectively. Nonetheless, the frequency bands are lowered on the whole, and peak levels are greatly decreased as compared to the case where the passive radiator is not installed (FIG. 16(A)).

In this manner, by installing the passive radiator (the edge-cum-diaphragm 102B) to the pipe 102, the speaker apparatus 100 is adapted to suppress the high-order resonance of an odd-numbered order that is not pleasant for a human ear and enhance the output of sound in the further lower pitch range as compared to the case where the passive radiator is not installed.

In effect, the speaker apparatus 100 can enhance the output in the low pitch range without making a user perceive a particularly major change in appearance, by means of a simple structure in which the edge-cum-diaphragm 102B as transparent as the pipe 102 is installed without varying the length and the diameter (volume) of the pipe 102.

Particularly in the speaker apparatus 100, a lower range reproduction frequency is determined according to the length of the pipe 102 that functions as the resonance tube. When the resonance tube and the passive radiator are used, the lower range reproduction frequency is determined according to the length of the resonance tube, stiffness (mobility of the diaphragm) of the passive radiator, and the weight of the passive radiator itself (the edge-cum-diaphragm 102B weighs 4.2 [g] in this case).

That is to say, the speaker apparatus 100 is adapted to be capable of controlling the lower range reproduction frequency by optimizing the stiffness and the mass of the passive radiator (the edge-cum-diaphragm 102B) with respect to the pipe 102 (weighing 1232 [g] in this case), even when the length of the pipe 102 as the resonance tube is not sufficient.

Conversely, the speaker apparatus 100 can have the shorter pipe 102 than heretofore set to achieve further downsizing, since the reproduction of sound in the yet lower pitch range can be realized even when the length of the pipe 102 as the resonance tube is not sufficient.

[1-9. Illumination Effect Through the Passive Radiator]

In this speaker apparatus 100 (FIG. 3), the irradiation light from the total of six LED light bulbs 132 disposed at 60-degree intervals on the stays 131 disposed to cover the rear surface side of the speaker unit 104 is diffused by the diffuser panel 133 and passes through the pipe 102 as the diffused light.

Figure 17:
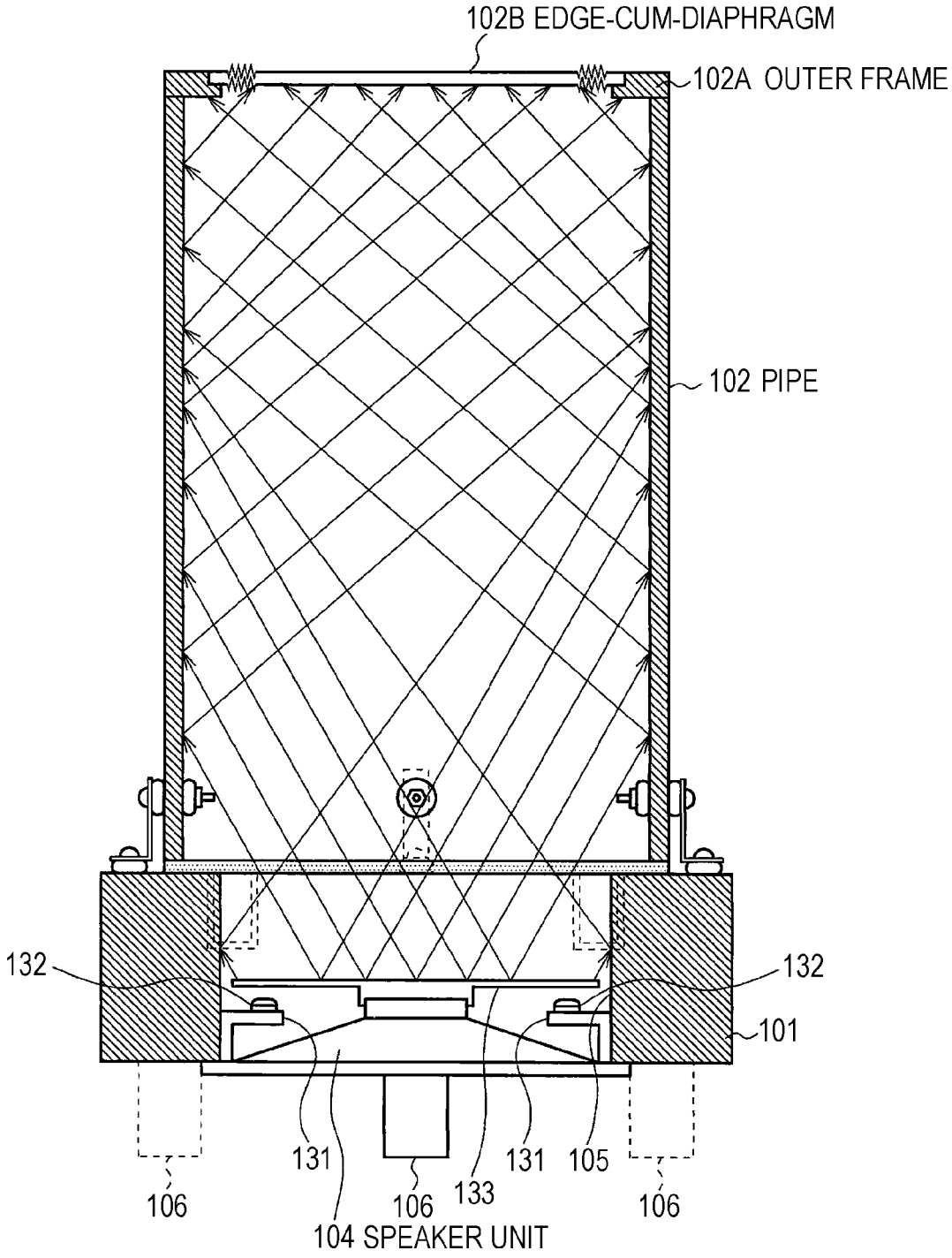
FIG. 17 is a schematic cross-sectional view illustrating an edge-cum-diaphragm irradiated with light that propagates through a pipe.

At this time, in the speaker apparatus 100, the diffused light diffused by the diffuser panel 133 is reflected off the inner surface of the pipe 102, reaches the edge-cum-diaphragm 102B thereafter, and irradiates the edge-cum-diaphragm 102B, as shown in FIG. 17.

The pipe 102 here is formed of the acrylic resin having the translucent property or the light-guiding property as mentioned above, thereby reflecting the diffused light diffused by the diffuser panel 133 off the inner surface of the pipe 102 and efficiently bringing the light to reach the edge-cum-diaphragm 102B.

The edge-cum-diaphragm 102B is also a light diffuser panel with the light-diffusing property and thus further diffuses the diffused light having passed through the pipe 102 to radiate it to the outside.

Here, the edge-cum-diaphragm 102B functions as the passive radiator and vibrates in synchronization with the low-pitched sound output from the speaker unit 104. As a result, the speaker apparatus 100 can form the light emission state in which the sound from the speaker unit 104 and from the vibration of the edge-cum-diaphragm 102B is in synchronization with the light radiated through the edge-cum-diaphragm 102B.

[1-10. Operation and Effect]

With the construction above, the edge-cum-diaphragm 102B, which is provided on the other end side of the pipe 102 to face the speaker unit 104 on the one end side of the pipe 102, functions as the passive radiator for enhancing the low pitch range in the speaker apparatus 100.

In the speaker apparatus 100, the speaker unit 104 requires an electrical connection to supply the audio signal. On the other hand, the electrical connection is not required for the edge-cum-diaphragm 102B that vibrates in response to the sound wave of the negative phase radiated from the rear surface of the speaker unit 104, thereby allowing the structure to be simplified.

The speaker apparatus 100 can obtain the effect of efficiently enhanced low-pitched sound by the combination of the pipe 102 and the edge-cum-diaphragm 102B, since the edge-cum-diaphragm 102B functions as the passive radiator, and the pipe wall of the pipe 102 is excited to vibration by the sound wave SEB of the negative phase from the rear surface of the speaker unit 104 and functions as the resonance tube.

Moreover, the speaker apparatus 100 appears no different from the conventional structure in which no passive radiator is provided because both of the pipe 102 and the edge-cum-diaphragm 102B are transparent and invisible to a user's eye. Therefore, the speaker apparatus would neither have to give the user any special sense of discomfort nor lose the original designability.

Furthermore, the inner space of the pipe 102 of the speaker apparatus 100 is sealed from above by the edge-cum-diaphragm 102B provided at the upper end of the pipe 102. As a result, the speaker apparatus would be able to prevent dust from entering the pipe in advance and avoid an adverse influence on sound resulting from the motions of the piezoelectric actuator 103 and the drive rod 103A being obstructed by the dust.

Moreover, the edge-cum-diaphragm 102B of the speaker apparatus 100 is constructed such that the edge part EG and the diaphragm part BC are formed integrally. Therefore, there is no need to individually tune the edge part and the diaphragm part after sticking them together, as heretofore performed. Simply, the edge-cum-diaphragm 102B as a whole needs tuning, which can resolve the complication at the time of manufacturing.

According to the above construction, the speaker apparatus 100 can enhance the low pitch range without complicating the construction thereof nor increasing the size of the pipe 102 by making the edge-cum-diaphragm 102B function as the passive radiator for enhancing the low pitch range, the edge-cum-diaphragm 102B being provided at the other end side of the pipe 102 in a manner facing the speaker unit 104 provided at the one end side of the pipe 102.

<2. Another Embodiment>

Described in the aforementioned embodiment is the case where sound is output from the entire outer surface of the pipe 102 by vibrating the pipe 102 with the vibration component directed orthogonal to the end surface on the lower end side of the pipe 102 from the end surface through the drive rod 103A of the piezoelectric actuator 103. However, the present invention may also be adapted to excite and vibrate the pipe wall of the pipe 102 by means of the sound wave of the negative phase radiated from the rear surface side of the speaker unit 104 alone without using the piezoelectric actuator 103.

Figure 2:
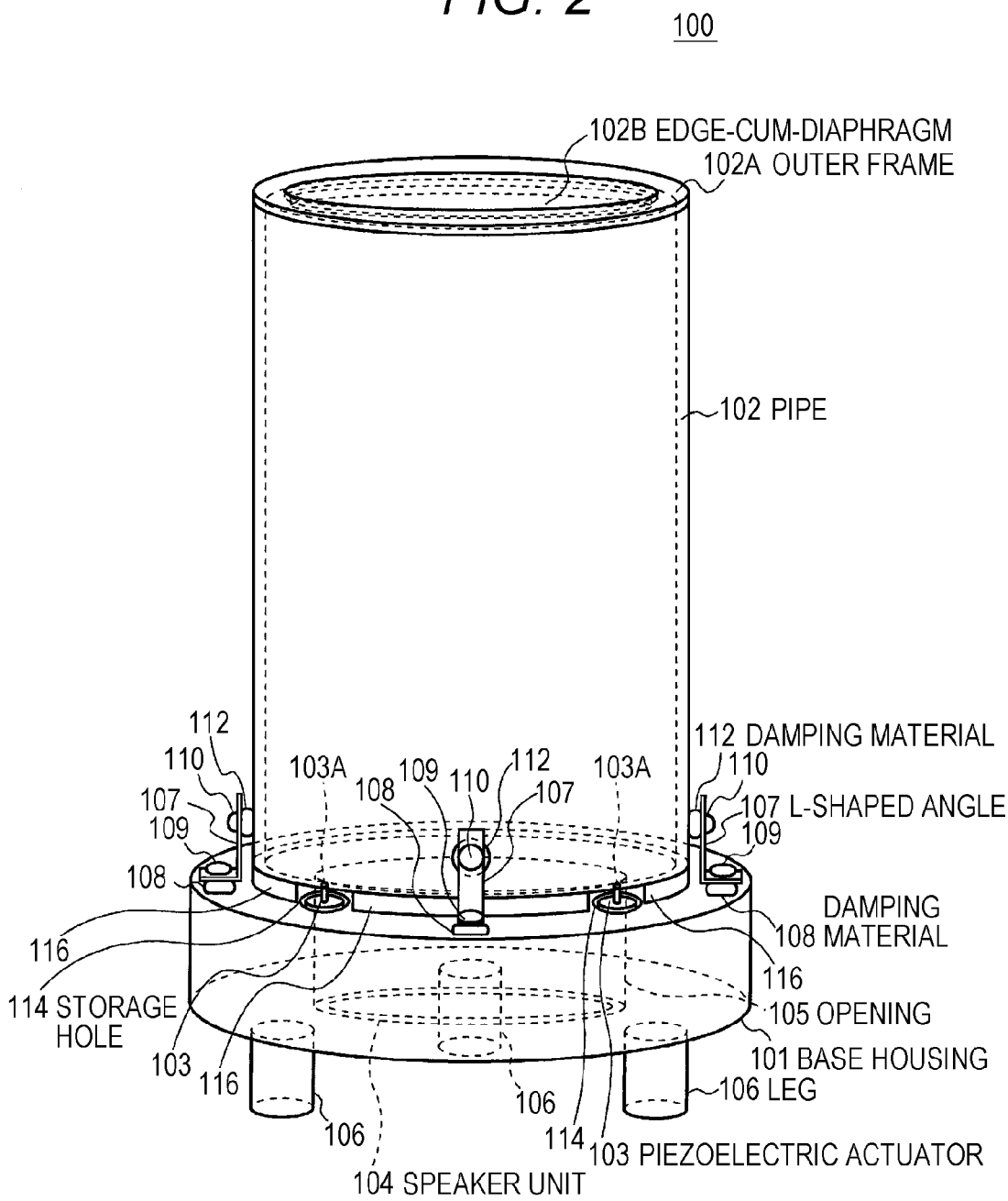
FIG. 2 is a schematic perspective view illustration an overall construction of a speaker apparatus.
Figure 3:
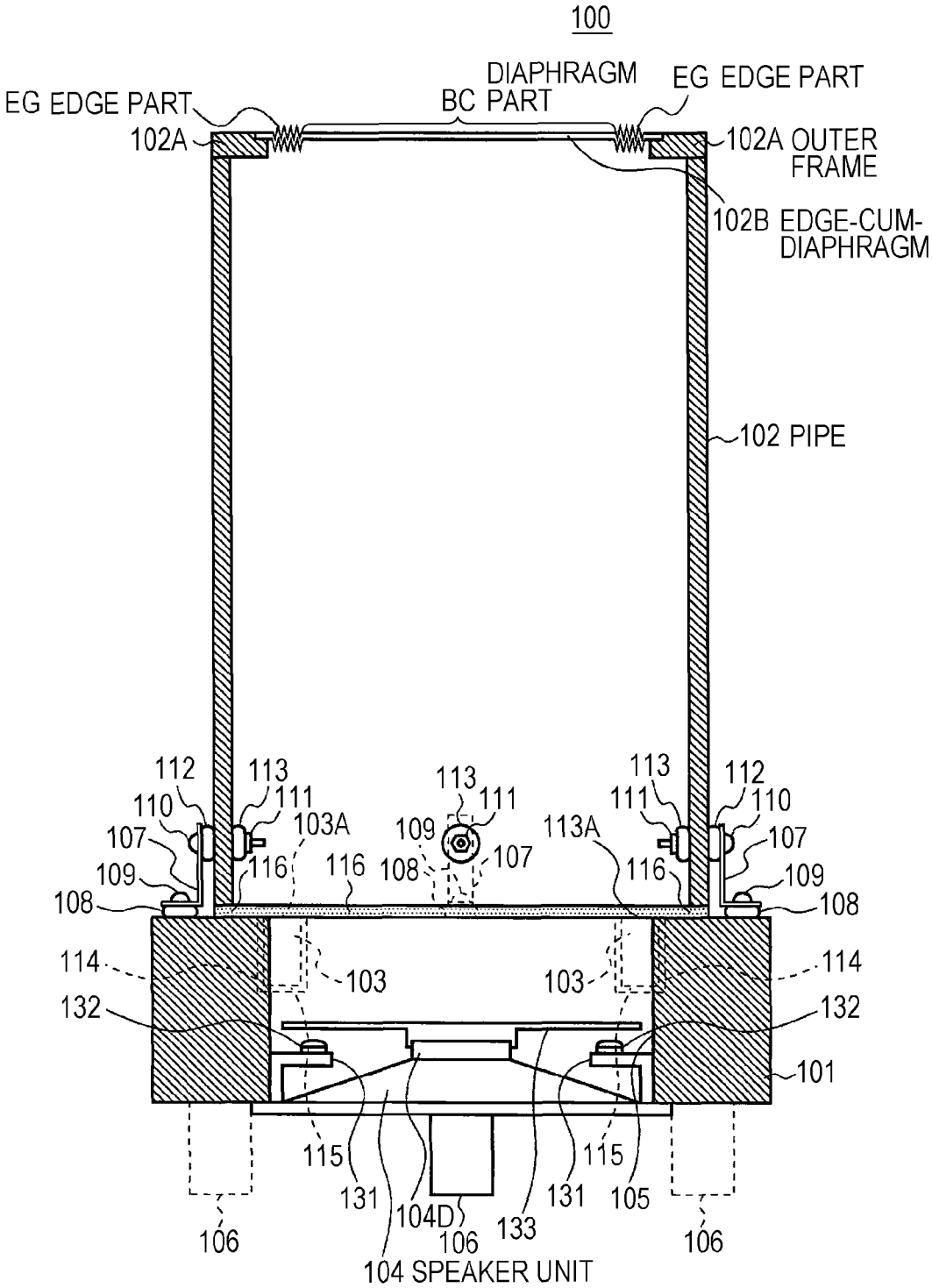
FIG. 3 is a schematic longitudinal section illustrating a cross-sectional construction of the speaker apparatus.
Figure 4:
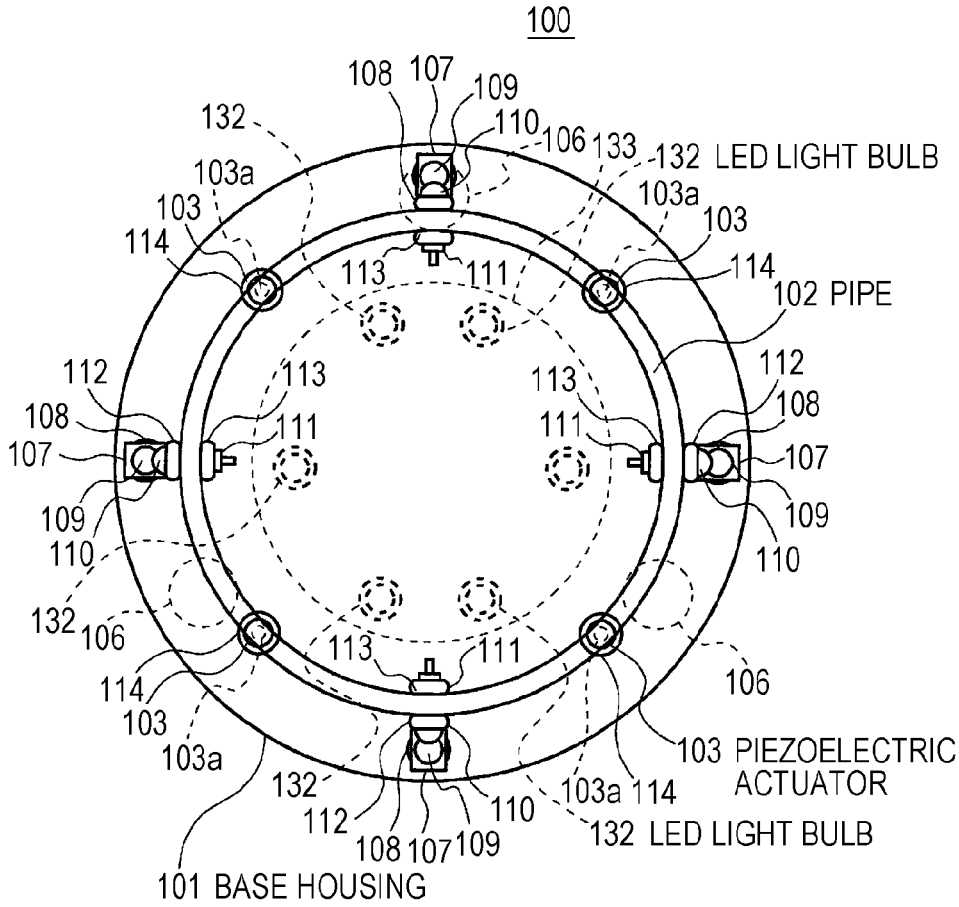
FIG. 4 is a set of schematic top views illustrating a construction of a top surface of the speaker apparatus.
Figure 4:
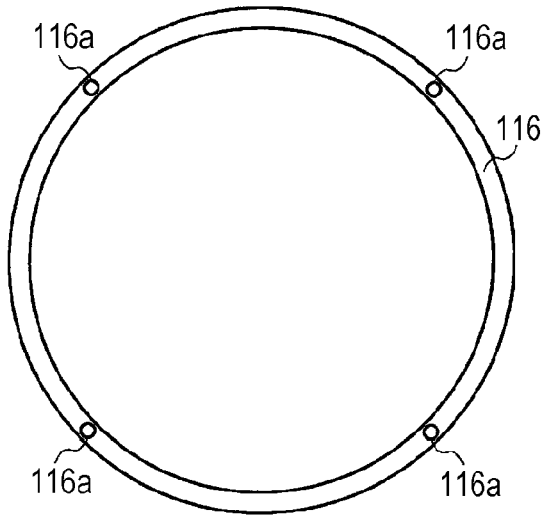
Figure 5:
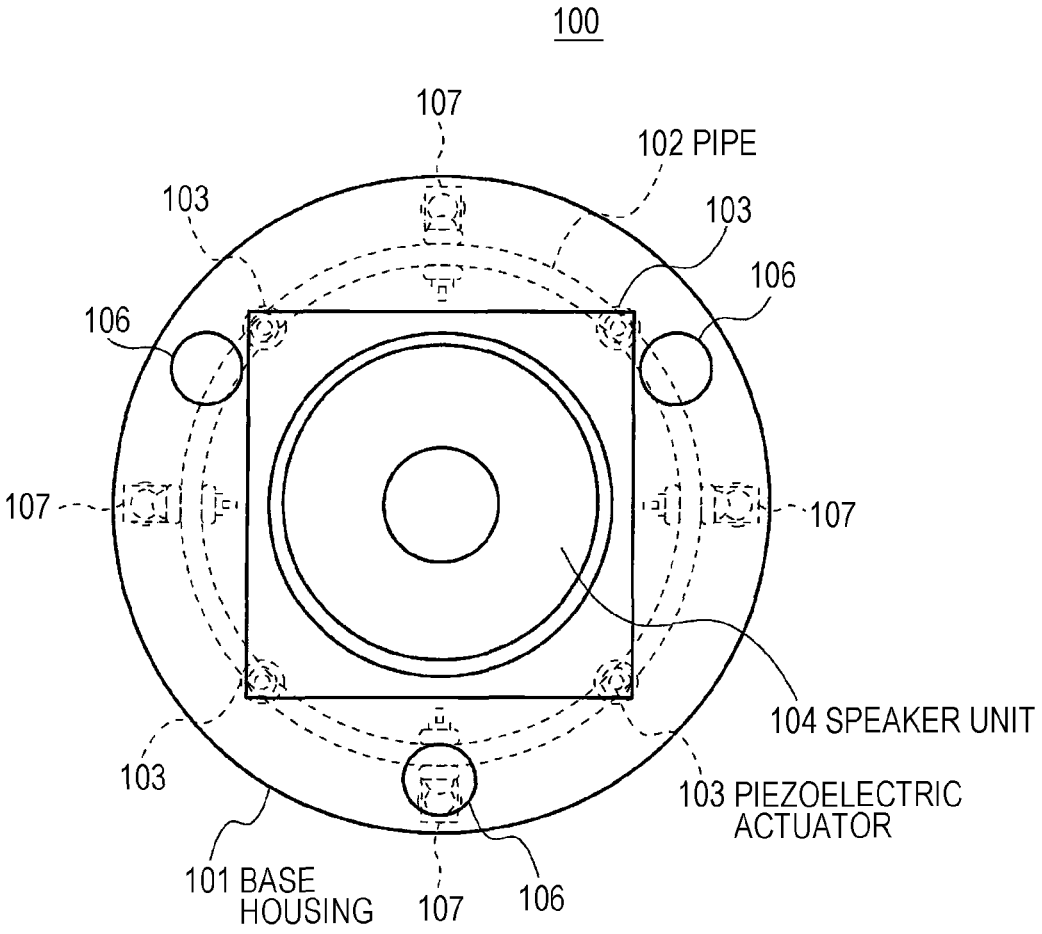
FIG. 5 is a schematic bottom view illustrating a construction of a bottom surface of the speaker apparatus.
Figure 18:
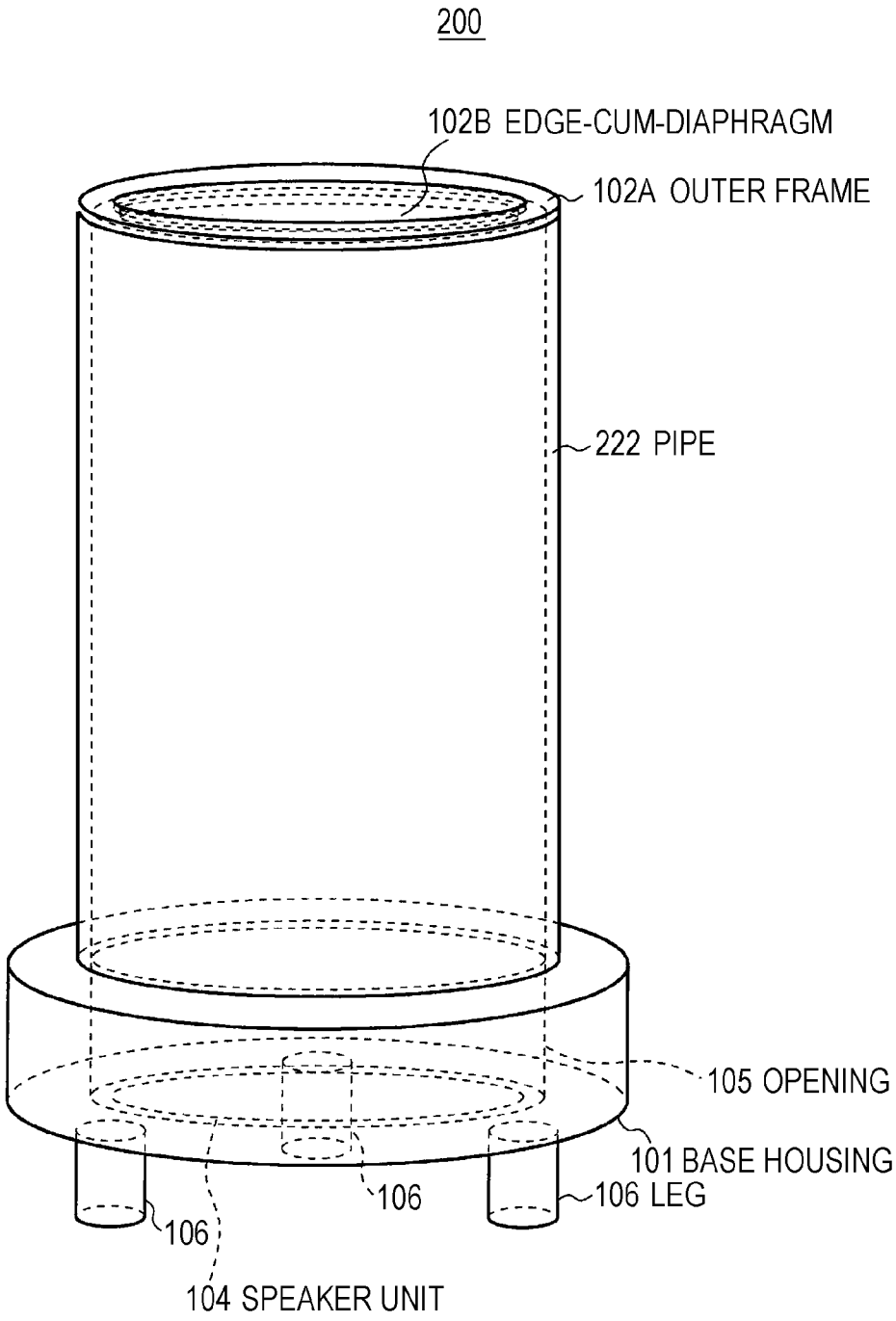
FIG. 18 is a schematic view illustrating an overall construction of a speaker apparatus according to another embodiment.
Figure 19:
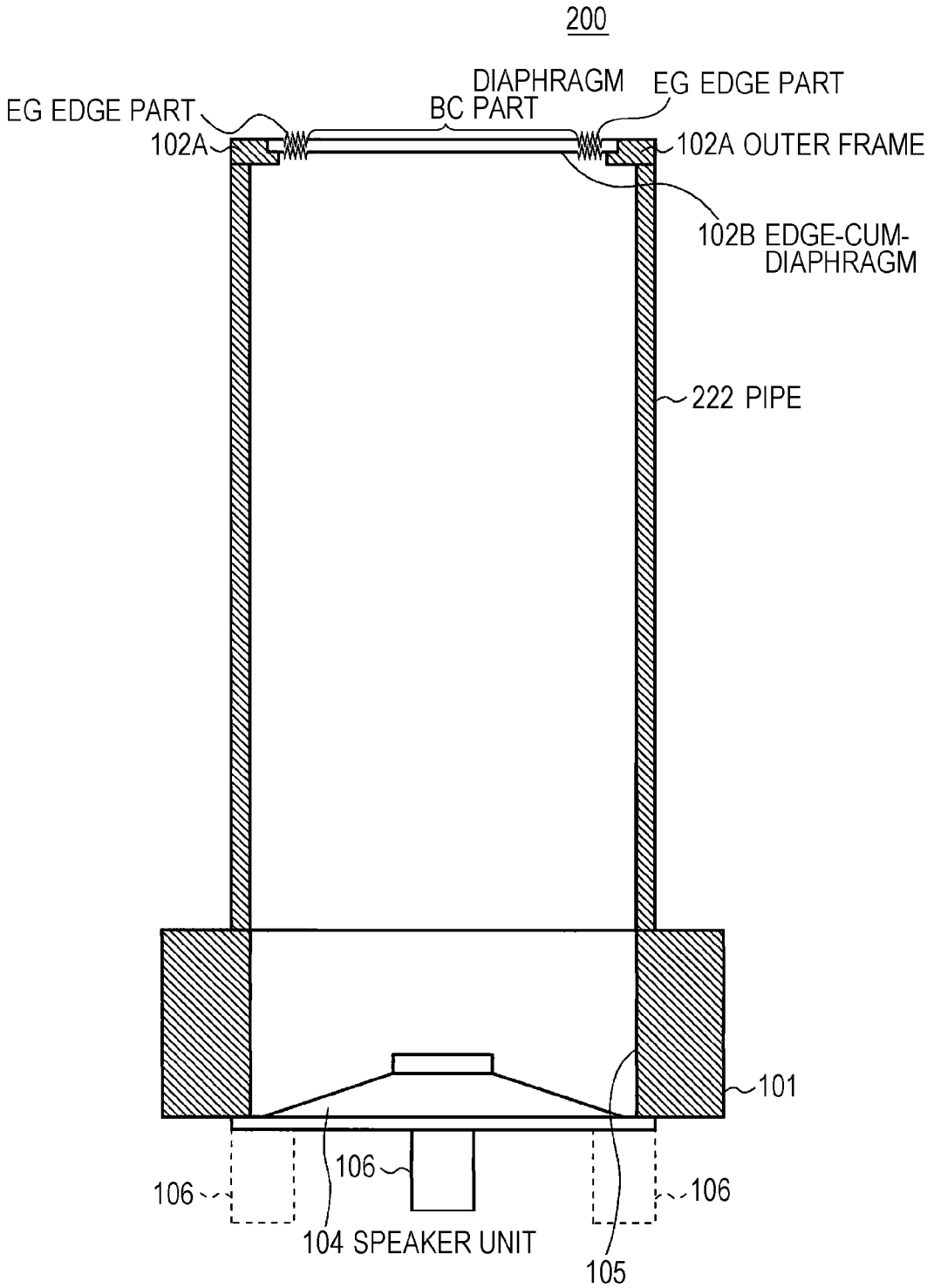
FIG. 19 is a schematic view illustrating a cross-sectional construction of the speaker apparatus according to the other embodiment.
Figure 20:
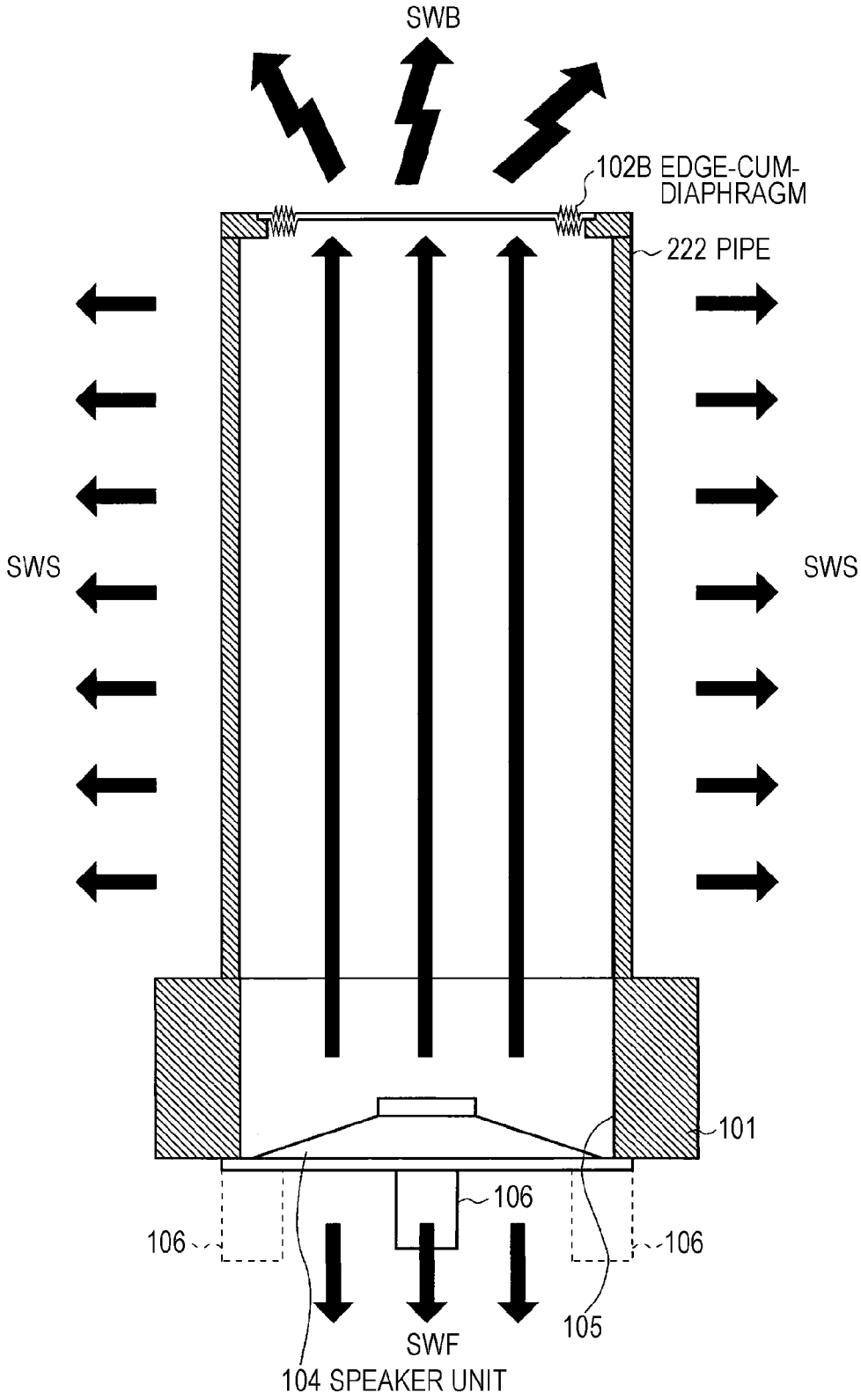
FIG. 20 is a schematic view provided to describe a state of sound wave radiation according to the other embodiment.

Specifically, as shown in FIGS. 18 to 20 in which parts corresponding to those in FIG. 2 are assigned the same reference signs as FIG. 2, a speaker apparatus 200 includes a base housing 101, a pipe 222, and a speaker unit 104 using an electrodynamic actuator, and does not include the piezoelectric actuator 103 that directly vibrates the pipe 102 as is the case for the speaker apparatus 100.

The pipe 222 is formed light and thin to the extent that the pipe 222 can vibrate in response to a sound wave from the speaker unit 104. For example, this pipe 222 is formed of a polycarbonate or an acrylic resin with a thickness of 0.5 mm.

The pipe 222 is opened on one end side and the other end side, where the lower end on the one end side is fixed to a top surface of the base housing 101 by using an adhesive, for example, and an edge-cum-diaphragm 102B as described above is installed on the other end side through an outer frame 102A.

The pipe 222 has a diameter substantially identical to a diameter of an opening 105 formed in the base housing 101 in order to function as a resonance tube. At the same time, the pipe 222 is fixed in position with respect to the opening 105.

The speaker unit 104 is installed by using a screw (not shown), for example, in a position corresponding to the opening 105 on the bottom surface side of the base housing 101 while facing downward. The speaker unit 104 is disposed on the same axis as the pipe 222 and driven on the basis of an audio signal.

A sound wave SWF (FIG. 20) of a positive phase output from the front surface of the speaker unit 104 is radiated outside from the bottom surface side of the base housing 101. A sound wave SWB of a negative phase output from the rear surface of the speaker unit 104 passes through the opening 105 and the pipe 222 and is radiated outside in a state where a low pitch range has been enhanced through the edge-cum-diaphragm 102B provided on the upper end side of the pipe 222.

A pipe wall of the pipe 222 vibrates in response to the sound wave SWB of the negative phase that passes through the pipe 222, whereby a sound wave SWS corresponding to the audio signal associated with driving the speaker unit 104 is radiated outward from the entire outer surface of the pipe 222. As a consequence, a user can feel uniform sound pressure at each position in a longitudinal direction of the pipe 222 and thus obtain an audio image that is spread throughout the pipe 222.

In addition to the pipe 222 functioning as the resonance tube, the edge-cum-diaphragm 102B disposed in the position facing the speaker unit 104 functions as a passive radiator, thereby further enhancing the low pitch range.

Moreover, in the case described in the aforementioned embodiment, the edge-cum-diaphragm 102B formed of a urethane material is installed to the outer frame 102A on the upper end surface of the pipe 102. However, the present invention may also have a construction in which an edge formed of a urethane material is installed to the outer frame 102A, and a diaphragm formed of materials such as the acrylic resin, carbon, paper and various other materials is installed to the edge.

Furthermore, the transparent edge-cum-diaphragm 102B formed of the urethane material is used in the aforementioned embodiment. However, the present invention may also use the transparent edge-cum-diaphragm 102B formed of an ester material or of a styrene material if the edge-cum-diaphragm 102B does not need to be transparent.

Figure 21:
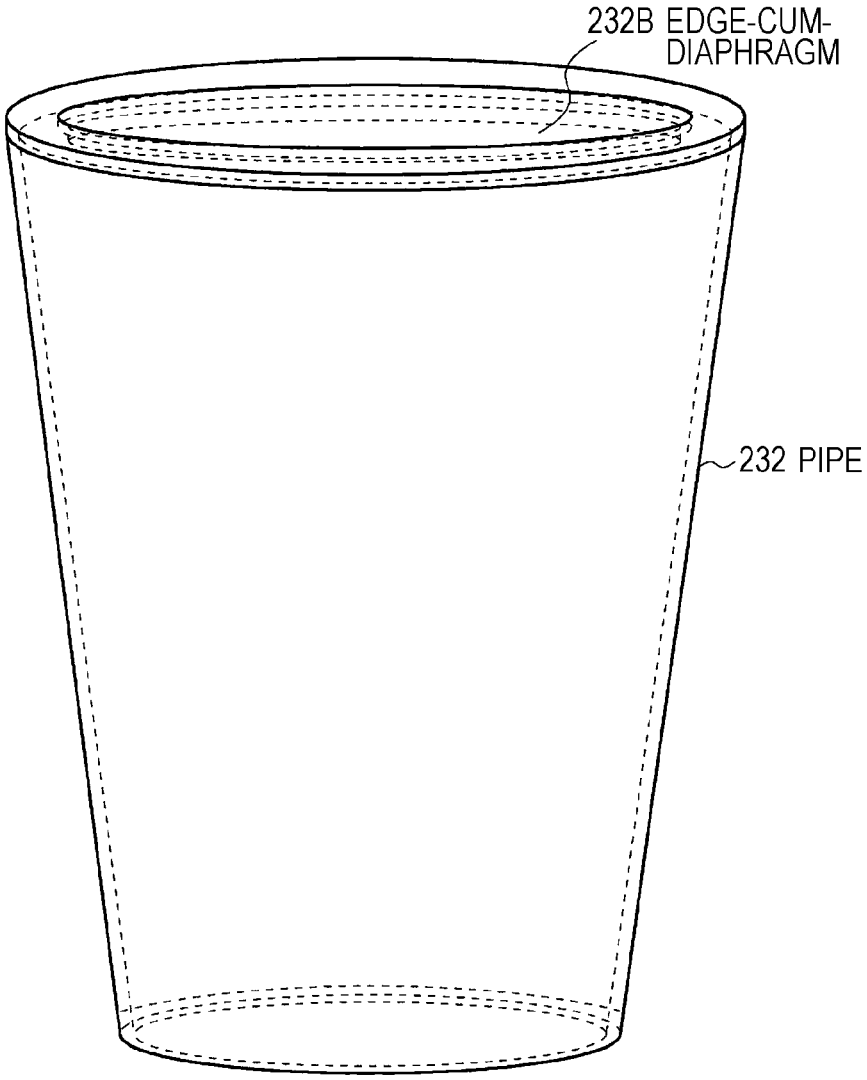
FIG. 21 is a schematic view illustrating a pipe construction according to the other embodiment.

Furthermore, the cylindrical pipe 102 is used in the aforementioned embodiment. However, the present invention may also use a pipe 232 such that the diameter thereof gradually becomes larger in a traveling direction of the sound wave SWB from the speaker unit 104, as shown in FIG. 21, for example.

In this case, the pipe 232 can exert the same effect as when the pipe 102 is used. In addition, having the gradually larger diameter in the traveling direction of the sound wave SWB from the speaker unit 104, the pipe 232 would have the increased electrical inductance component and can obtain both flattening of frequency characteristics and a damping effect of resonance. Having a wide outlet from which the sound wave SWB is radiated, the pipe 232 can also obtain the effect in which the audio image can be spread more widely.

Figure 22:
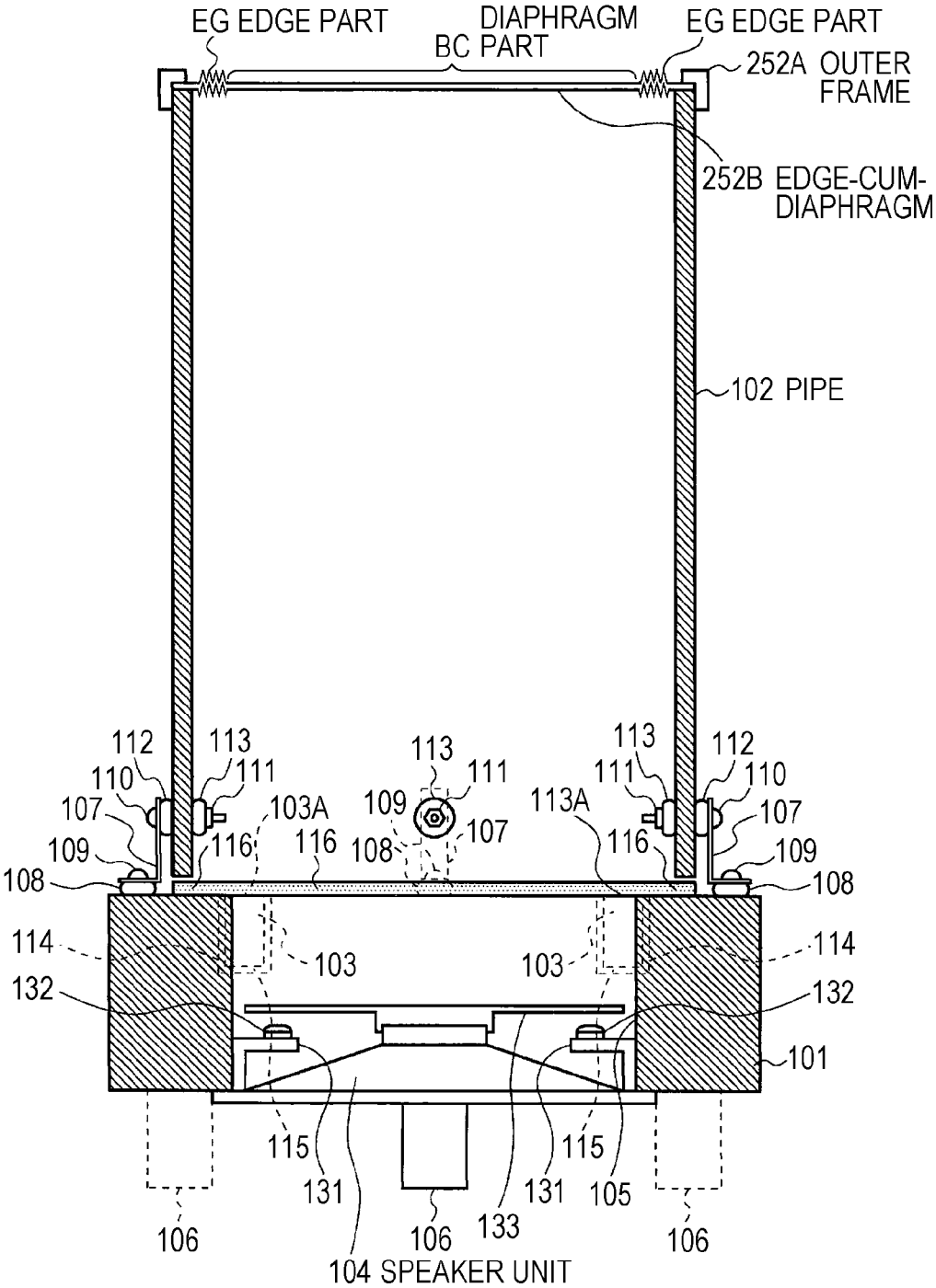
FIG. 22 is a schematic view illustrating a construction of an edge-cum-diaphragm according to the other embodiment.

Moreover, in the aforementioned embodiment, the edge-cum-diaphragm 102B is installed via the outer frame 102A. However, as shown in FIG. 22, the present invention may also have a construction such that an edge-cum-diaphragm 252B is directly adhered to the upper end of the pipe 102 without using the outer frame 102A and that an outer frame 252A is installed so as to cover the ends of the edge-cum-diaphragm 252B and the pipe 102.

In this case, the outer diameter of the pipe 102 corresponds with that of the edge-cum-diaphragm 252B, so that the edge-cum-diaphragm 252B would be present throughout the inner diameter of the pipe 102. As a result, the entire surface of the edge-cum-diaphragm 252B would ideally operate as a passive radiator by the direct sound wave SWB output from the rear surface of the speaker unit 104.

Furthermore, in this case, the vibration by the piezoelectric actuator 103 of the pipe 102 would be propagated from an excitation point to the upper end surface. A reflected wave generated on the upper end surface would be suppressed by the edge part EG of the edge-cum-diaphragm 252B, thereby preventing a standing wave from being generated by the reflected wave.

Figure 23:
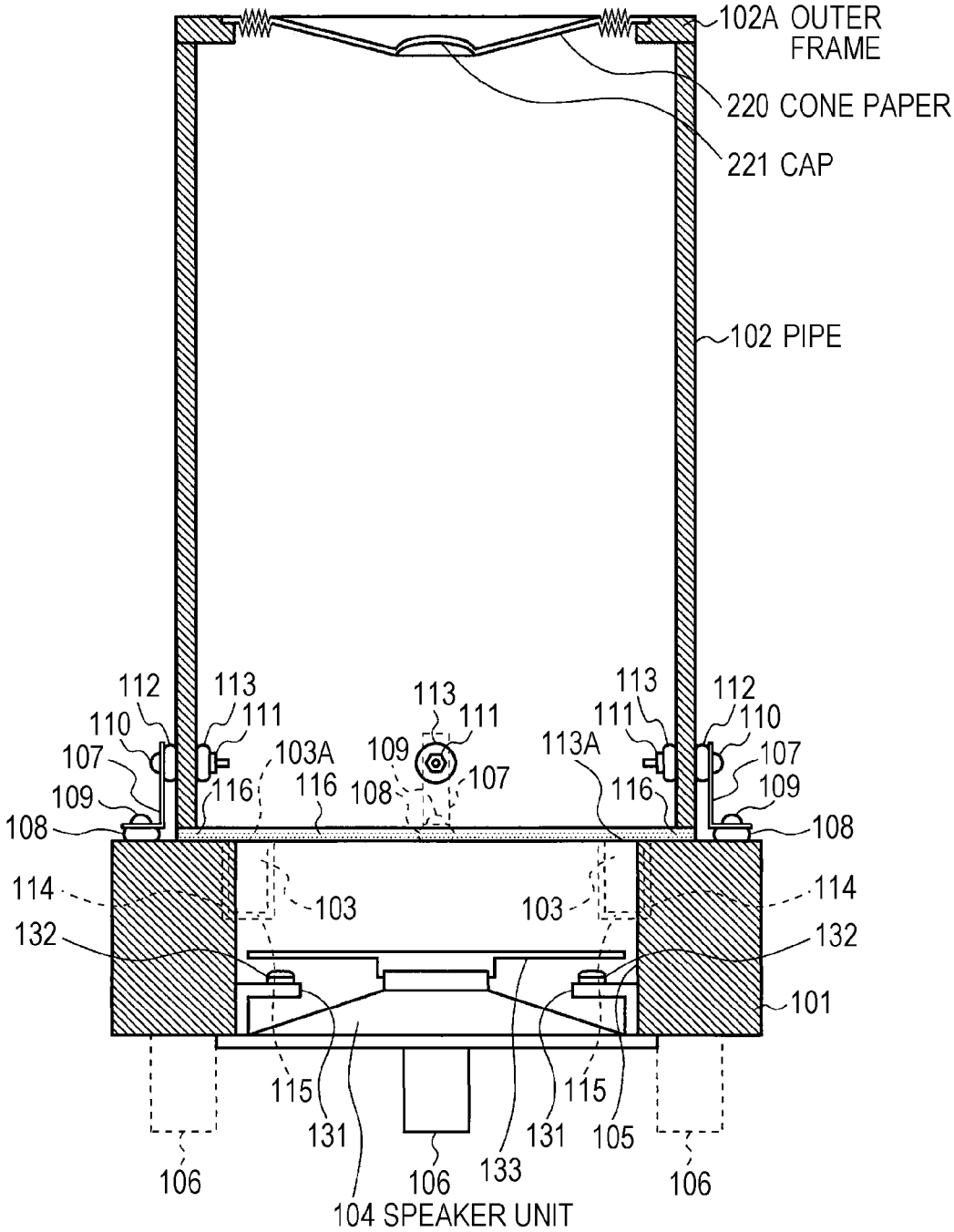
FIG. 23 is a schematic view illustrating a construction of the edge-cum-diaphragm according to the other embodiment.

Furthermore, in the aforementioned embodiment, the edge-cum-diaphragm 102B is installed via the outer frame 102A. However, as shown in FIG. 23, the present invention may also have a construction such that a cone paper 220 and a cap 221 as used in a typical speaker unit are installed in place of the edge-cum-diaphragm 102B via the outer frame 102A.

Furthermore, in the aforementioned embodiment, the speaker apparatus of the present invention includes the pipe 102 as the cylindrical member, the speaker unit 104 as the sounding body, and the edge-cum-diaphragm 102B as the diaphragm. However, the speaker apparatus of the present invention may also include the cylindrical member, the sounding body and the diaphragm that are formed by various other constituents.

INDUSTRIAL APPLICABILITY

The speaker apparatus and the audio output method of the present invention may be applicable to a speaker apparatus integrated into an audio-visual apparatus such as a television other than being used by itself as the speaker apparatus, for example.

REFERENCE SIGNS LIST

100, 200 Speaker apparatus
101 Base housing
102, 222, 232 Pipe
102B, 232B, 252B Edge-cum-diaphragm
103 Piezoelectric actuator
104 Speaker unit
105 Opening
106 Leg
107 L-shaped angle
108, 112, 113, 115, 116Damping material
131 Stay
132 LED light bulb
133 Diffuser panel
220 Cone paper
221 Cap

The invention claimed is:

1. A speaker apparatus comprising:

a cylindrical member open on one end side and the other end side;

a sounding body that is coaxial with the cylindrical member, arranged on the one end side of the cylindrical member, and driven on the basis of an audio signal; and a diaphragm that is coaxial with the cylindrical member, that is installed on the other end side of the cylindrical member, and that vibrates in response to a sound wave that passes through the cylindrical member;

wherein:

the cylindrical member functions as a resonance tube by being excited to vibration with the sound wave that is radiated from the sounding body and that passes through the cylindrical member, and the diaphragm functions as a passive radiator by vibrating in response to the sound wave that passes through the cylindrical member;

the speaker apparatus comprises an actuator configured to add a vibration component in a direction orthogonal to an end surface of the cylindrical member; and the cylindrical member is configured to output sound in a high pitch range from an outer surface thereof by vibration added by the actuator, and outputs sound in a low pitch range from the outer surface of the cylindrical member by being excited to vibration with the sound wave that is radiated from the sounding body and passes through the cylindrical member.

2. The speaker apparatus according to claim 1, wherein the diaphragm is integrally formed with the cylindrical member on the other end side thereof.

3. The speaker apparatus according to claim 2, wherein the cylindrical member and the diaphragm are formed of a transparent member.

4. The speaker apparatus according to claim 1, comprising a light source provided on a rear surface side of the sounding body, wherein light from the light source is received by the diaphragm to generate a light emission state synchronized with vibration of the diaphragm.

5. An audio output method, comprising acts of:

making a sound wave pass through a cylindrical member, the sound wave being coaxial with the cylindrical member opened on one end side and the other end side and being radiated on the basis of an audio signal from a sounding body arranged on the one end side of the cylindrical member; and vibrating a diaphragm, which is coaxial with the cylindrical member and installed on the other end side of the cylindrical member, in response to the sound wave that is radiated from the sounding body and passes through the cylindrical member, thereby allowing the diaphragm to function as a passive radiator;

wherein the act of making the sound wave pass through the cylindrical member comprises making the cylindrical member function as a resonance tube by exciting the cylindrical member to vibration with the sound wave radiated from the sounding body; and wherein the audio output method further comprises acts of:

adding a vibration, by an actuator, in a direction orthogonal to an end surface of the cylindrical member;

outputting sound in a high pitch range, by the cylindrical member from an outer surface thereof, in response to the vibration added by the actuator; and outputting sound in a low pitch range, by the cylindrical member from an outer surface thereof, in response to the sound wave radiated from the sounding body.

6. The audio output method of claim 5, wherein the act of vibrating a diaphragm comprises vibrating a diaphragm that is integrally formed with the cylindrical member on the other end side thereof.

7. The audio output method of claim 5, further comprising acts of:

receiving, by the diaphragm, light from a light source provided on a rear surface side of the sounding body; and generating, by the diaphragm, a light emission state synchronized with vibration of the diaphragm.

* * * * *